US011224258B2

(12) United States Patent
Berns et al.

(10) Patent No.: US 11,224,258 B2
(45) **Date of Patent: *Jan. 18, 2022**

(54) GARMENT WITH TENSION CLOSURE POCKET

(71) Applicant: Under Armour, Inc., Baltimore, MD (US)

(72) Inventors: Jason Berns, Baltimore, MD (US); Merida Miller, Baltimore, MD (US)

(73) Assignee: UNDER ARMOUR, INC., Baltimore, MD (US)

( * ) Notice: Subject to any disclaimer, the term of this patent is extended or adjusted under 35 U.S.C. 154(b) by 267 days.

This patent is subject to a terminal disclaimer.

(21) Appl. No.: 16/527,831

(22) Filed: Jul. 31, 2019

(65) Prior Publication Data

US 2019/0350281 A1 Nov. 21, 2019

Related U.S. Application Data

(63) Continuation of application No. 15/439,006, filed on Feb. 22, 2017, now Pat. No. 10,398,183.

(Continued)

(51) Int. Cl.
*A41D 27/20* (2006.01)
*A41D 1/085* (2018.01)

(Continued)

(52) U.S. Cl.
CPC ..... *A41D 27/205* (2013.01); *A41D 1/085* (2018.01); *A41D 27/207* (2013.01); *A41F 9/00* (2013.01);

(Continued)

(58) Field of Classification Search
CPC ..... A41D 27/205; A41D 1/085; A41D 1/14; A41D 1/06; A41D 13/0012; A41D 1/21; A41B 9/004; A41B 9/001; A41C 1/08
See application file for complete search history.

(56) References Cited

U.S. PATENT DOCUMENTS 1,920,061 A 7/1933 Carr
2,255,931 A 9/1941 Kloster (Continued)

FOREIGN PATENT DOCUMENTS

AU 2012254915 A1 6/2013
CN 2805419 8/2006

(Continued)

OTHER PUBLICATIONS

Athleta Catalog, Runabout Pant, Item J, p. 37, Fall 2011, Petaluma, California.

(Continued)

*Primary Examiner* — Khaled Annis
(74) *Attorney, Agent, or Firm* — Edell, Shapiro & Finnan LLC

(57) ABSTRACT

A garment or article of clothing made of a resilient/elastomeric material includes at least a waist portion, a first leg portion, and a second leg portion. The waist portion further includes a pocket on the rear of the garment, where the pocket is defined by a backing panel, a first flap, and a second flap. The first flap is at least partially disposed over the second flap to secure contents between the backing panel and the second panel, and thus, within the pocket. When the waist portion is stretched, the tensile forces imparted onto the waist portion by the resilient/elastomeric material causes the first flap to at least partially overlie the second flap. The pocket is sized and shaped to receive smartphones and other small personal items, such as keys, money, credit cards, identifications, etc.

20 Claims, 16 Drawing Sheets

Related U.S. Application Data

(60) Provisional application No. 62/298,102, filed on Feb. 22, 2016.

(51) Int. Cl.

| | |
|---|---|
| ***A41F 9/00*** | (2006.01) |
| *A41D 1/21* | (2018.01) |
| *A41D 13/00* | (2006.01) |
| *A41B 9/00* | (2006.01) |
| *A41B 9/02* | (2006.01) |
| *A41D 1/08* | (2018.01) |

(52) U.S. Cl.

CPC ..... *A41B 9/001* (2013.01); *A41B 9/004* (2013.01); *A41B 9/02* (2013.01); *A41B 9/023* (2013.01); *A41B 9/026* (2013.01); *A41D 1/08* (2013.01); *A41D 1/21* (2018.01); *A41D 13/0012* (2013.01)

(56) References Cited

U.S. PATENT DOCUMENTS

| | | | |
|---|---|---|---|
| 2,492,862 | A | 12/1949 | Harvey |
| 2,930,046 | A | 3/1960 | Sagner |
| 3,137,862 | A | 6/1964 | Mizerak |
| 3,487,833 | A | 1/1970 | Senser |
| 3,871,030 | A | 3/1975 | Green |
| D235,937 | S | 7/1975 | Froidh |
| D275,619 | S | 9/1984 | Birring |
| D281,540 | S | 12/1985 | Ternstrom |
| D284,036 | S | 6/1986 | Birring |
| 4,852,188 | A | 8/1989 | Marsh et al. |
| D315,630 | S | 3/1991 | Larsen |
| 5,012,543 | A | 5/1991 | Lewis, Sr. |
| 5,161,257 | A | 11/1992 | Arensdorf et al. |
| 5,172,430 | A | 12/1992 | Lerma-Solis |
| D339,902 | S | 10/1993 | Doherty |
| 5,544,366 | A | 8/1996 | Kato |
| 5,561,865 | A | 10/1996 | Fjelstul |
| D378,947 | S | 4/1997 | Desmond |
| 5,649,328 | A | 7/1997 | Martin |
| D382,386 | S | 8/1997 | Malone |
| 5,671,481 | A | 9/1997 | Giard |
| 5,724,679 | A | 3/1998 | Hans |
| 5,870,777 | A | 2/1999 | Hans |
| 5,954,564 | A | 9/1999 | Ganz |
| 6,006,363 | A | 12/1999 | Karlin |
| 6,023,789 | A | 2/2000 | Wilson et al. |
| 6,041,441 | A | 3/2000 | Counts et al. |
| 6,161,222 | A | 12/2000 | Strickland et al. |
| 6,363,538 | B1 | 4/2002 | Davis |
| 6,532,599 | B1 | 3/2003 | Dugan |
| D514,774 | S | 2/2006 | Africa et al. |
| D515,282 | S | 2/2006 | Africa |
| 7,024,703 | B1 | 4/2006 | Della Ratta |
| D532,958 | S | 12/2006 | Kent |
| 7,231,672 | B2 | 6/2007 | Thomas |
| 7,364,491 | B2 | 4/2008 | Updyke |
| D572,430 | S | 7/2008 | Wong |
| 7,434,273 | B2 | 10/2008 | Chung |
| D613,037 | S | 4/2010 | Iamartino et al. |
| D613,928 | S | 4/2010 | Iamartino et al. |
| D615,279 | S | 5/2010 | Savage |
| D618,434 | S | 6/2010 | Iamartino et al. |
| D618,435 | S | 6/2010 | Iamartino et al. |
| D619,784 | S | 7/2010 | Kanada et al. |
| 7,753,759 | B2 | 7/2010 | Pintor et al. |
| 7,788,739 | B1 | 9/2010 | Della Ratta |
| D641,134 | S | 7/2011 | Zarabi |
| D641,539 | S | 7/2011 | Zarabi |
| D645,644 | S | 9/2011 | Iamartino |
| D646,047 | S | 10/2011 | Arensdorf |
| 8,028,345 | B2 | 10/2011 | Waite et al. |
| D650,589 | S | 12/2011 | Overton et al. |
| 8,104,654 | B2 | 1/2012 | Overton |
| D654,661 | S | 2/2012 | Savage |
| D659,290 | S | 5/2012 | Overton |
| D660,553 | S | 5/2012 | Farina et al. |
| D661,872 | S | 6/2012 | Iamartino |
| D662,281 | S | 6/2012 | Iamartino |
| D663,075 | S | 7/2012 | Overton |
| 8,214,922 | B2 | 7/2012 | Moore et al. |
| 8,257,140 | B2 | 9/2012 | Kenny |
| 8,272,073 | B2 | 9/2012 | Arensdorf et al. |
| D668,434 | S | 10/2012 | Iamartino |
| 8,312,568 | B2 | 11/2012 | Marois et al. |
| 8,321,964 | B2 | 12/2012 | Gernes |
| D673,756 | S | 1/2013 | Agnew et al. |
| 8,407,816 | B2 | 4/2013 | Rhoades et al. |
| D686,801 | S | 7/2013 | Farina |
| D687,214 | S | 8/2013 | Farina et al. |
| 8,523,713 | B2 | 9/2013 | Roman |
| 8,555,419 | B2 | 10/2013 | Demarest et al. |
| 8,597,222 | B2 | 12/2013 | Lucero et al. |
| D702,018 | S | 4/2014 | Ferraro |
| D702,918 | S | 4/2014 | Radford |
| 8,745,768 | B1 | 6/2014 | Moghaddas |
| 8,938,815 | B2 | 1/2015 | Vaughn |
| D722,742 | S | 2/2015 | Abrams |
| 9,021,615 | B2 | 5/2015 | Cockram |
| D740,549 | S | 10/2015 | Nejjar |
| D741,045 | S | 10/2015 | Scherr |
| D743,144 | S | 11/2015 | Swan |
| D746,022 | S | 12/2015 | Maier |
| D747,844 | S | 1/2016 | Dawson |
| D747,845 | S | 1/2016 | Pasloski |
| D753,896 | S | 4/2016 | Yoo |
| 9,307,792 | B2 | 4/2016 | Crissman |
| D756,069 | S | 5/2016 | Astin |
| D759,345 | S | 6/2016 | Astin |
| D768,357 | S | 10/2016 | White |
| 2004/0031830 | A1 | 2/2004 | Davis |
| 2008/0083055 | A1 | 4/2008 | Onda |
| 2008/0189832 | A1 | 8/2008 | Oscher |
| 2009/0067150 | A1 | 3/2009 | Ito |
| 2010/0281595 | A1 | 11/2010 | Gernes |
| 2011/0009793 | A1 | 1/2011 | Lucero |
| 2011/0131705 | A1 | 6/2011 | Waldman et al. |
| 2011/0225700 | A1 | 9/2011 | Kogut |
| 2012/0036615 | A1 | 2/2012 | Bradstreet et al. |
| 2012/0084903 | A1 | 4/2012 | Roberts et al. |
| 2012/0311758 | A1 | 12/2012 | Nicholson et al. |
| 2013/0026203 | A1 | 1/2013 | Overton |
| 2013/0048687 | A1 | 2/2013 | Do |
| 2013/0091619 | A1 | 4/2013 | Hacker et al. |
| 2013/0276210 | A1 | 10/2013 | Clarke et al. |
| 2013/0303052 | A1 | 11/2013 | Conrad |
| 2013/0305433 | A1 | 11/2013 | Hedrick |
| 2014/0115747 | A1 | 5/2014 | Spruill et al. |
| 2014/0143936 | A1 | 5/2014 | Flanagan |
| 2014/0182044 | A1 | 7/2014 | Cole |
| 2014/0196194 | A1 | 7/2014 | Clarke et al. |
| 2014/0276325 | A1 | 9/2014 | Turkbas |
| 2014/0283281 | A1 | 9/2014 | Willis |
| 2015/0128331 | A1 | 5/2015 | Grosse |
| 2015/0216245 | A1 | 8/2015 | Kinsley |
| 2016/0338435 | A1 | 11/2016 | Aihara |

FOREIGN PATENT DOCUMENTS

| | | | |
|---|---|---|---|
| DE | 19850874 | A1 | 2/2000 |
| EP | 0164309 | | 12/1985 |
| EP | 0493864 | | 7/1992 |
| GB | 2482934 | B | 7/2012 |
| JP | 2012101902 | A | 5/2012 |
| JP | 2012171673 | A | 9/2012 |
| WO | 9222463 | A1 | 12/1992 |
| WO | 2007088566 | A3 | 9/2007 |
| WO | 2008137810 | A1 | 11/2008 |

(56) References Cited

FOREIGN PATENT DOCUMENTS

| | | | |
|---|---|---|---|
| WO | 2010010340 | A3 | 4/2010 |
| WO | 2013020083 | A1 | 2/2013 |

OTHER PUBLICATIONS

Athleta Catalog, Organic Cotton Salamba Pant, p. 64, Fall 2011, Petaluma, California.
Athleta Catalog, Kickbooty Pant, p. 65, Fall 2011, Petaluma, California.

GARMENT WITH TENSION CLOSURE POCKET

CROSS-REFERENCE TO RELATED APPLICATIONS

This application is a continuation of U.S. non-provisional application Ser. No. 15/439,006, filed on Feb. 22, 2017 and entitled "Garment With Tension Closure Pocket," which claims priority under 35 U.S.C. 119(e) to U.S. Provisional Patent Application Ser. No. 62/298,102, entitled "Garment With Tension Closure Pocket", filed Feb. 22, 2016. The disclosures of the above applications are incorporated herein by reference in their entirety.

FIELD OF THE INVENTION

The present invention relates to an article of clothing or garment. More specifically, the present invention relates to pants, shorts, and other types of bottoms that contain a pocket with a tension closure, the pocket being configured to receive objects therein.

BACKGROUND OF THE INVENTION

Garments typically are equipped with pockets that enable the wearer of the garment to store items within the pockets. Garments equipped with conventional pockets allow items to fall out of the pocket, especially when the wearer of the garment is performing athletic activities. Thus, garments equipped with conventional pockets are often equipped with fasteners that enable the conventional pockets to securely store any items placed within the pockets. In addition, athletic garments equipped with conventional pockets may cause the garment to be uncomfortable and/or create unwanted and unflattering lines or bulges in the surface of the garment. Therefore, it would be desirable to provide an article of clothing, or garment, that is equipped with a pocket that securely stores personal items without the need for a fastener. It would also be desirable to provide a garment that retains personal items in a pocket while athletic activities and movements are performed by the wearer of the garment. It is further desirable to provide a garment equipped with at least one pocket that enables a wearer of the garment to store items in their pockets without creating unwanted lines and bulges on the surface of the garment.

BRIEF SUMMARY OF THE INVENTION

An article of clothing, or garment, disclosed herein includes a storage system with a tension closure pocket. The tension closure pocket of the garment is configured to apply increasing pressure across the opening of the pocket as forces that stretch the garment laterally increase. The tension closure pocket of the garment disclosed herein is configured to securely store personal items (smartphones, keys, identification, credit cards, money, etc.) while the wearer of the garment performs activities.

In one embodiment, an article of clothing includes a first leg portion, a second leg portion and a waist portion. The waist portion is coupled to the first leg portion and the second leg portion. The waist portion includes a backing panel, a first flap, and a second flap. The first flap and the second flap are both coupled to the backing panel in a configuration where the first flap is at least partially disposed over the second flap. The first flap, the second flap, and the backing panel define a pocket.

In another embodiment, an article of clothing includes a lower portion and an upper portion coupled to the lower portion. The lower portion is configured to be positioned around the legs of a person wearing the article of clothing. The upper portion is configured to be oriented around the waist of the person wearing the article of clothing. The upper portion includes a backing panel, a first flap, and a second flap. The first flap and the second flap each include an exterior surface and an interior surface. Furthermore, the first flap and the second flap are both coupled to the backing panel in a configuration where at least a portion of the interior surface of the first flap abuts at least a portion of the exterior surface of the second flap. The backing panel, the first flap, and the second flap collectively define a pocket.

In yet another embodiment, an article of clothing includes a lower portion and an upper portion coupled to the lower portion. The lower portion is configured to be positioned around the legs of a person wearing the article of clothing. The upper portion is configured to be oriented around the waist of the person wearing the article of clothing. The upper portion includes a backing panel, a first flap, and a second flap. The first flap and the second flap are both coupled to the backing panel such that the backing panel, the first flap, and the second flap collectively define a pocket. The first flap and the second flap are configurable between a closed position and an open position. In the closed position, the first flap at least partially covers a portion of the second flap. In the open position, the first flap is spaced apart from the second flap to provide access to the pocket.

BRIEF DESCRIPTION OF THE SEVERAL VIEWS OF THE DRAWINGS

Like reference numerals have been used to identify like elements throughout this disclosure.

DETAILED DESCRIPTION OF THE INVENTION

Figure 1A:
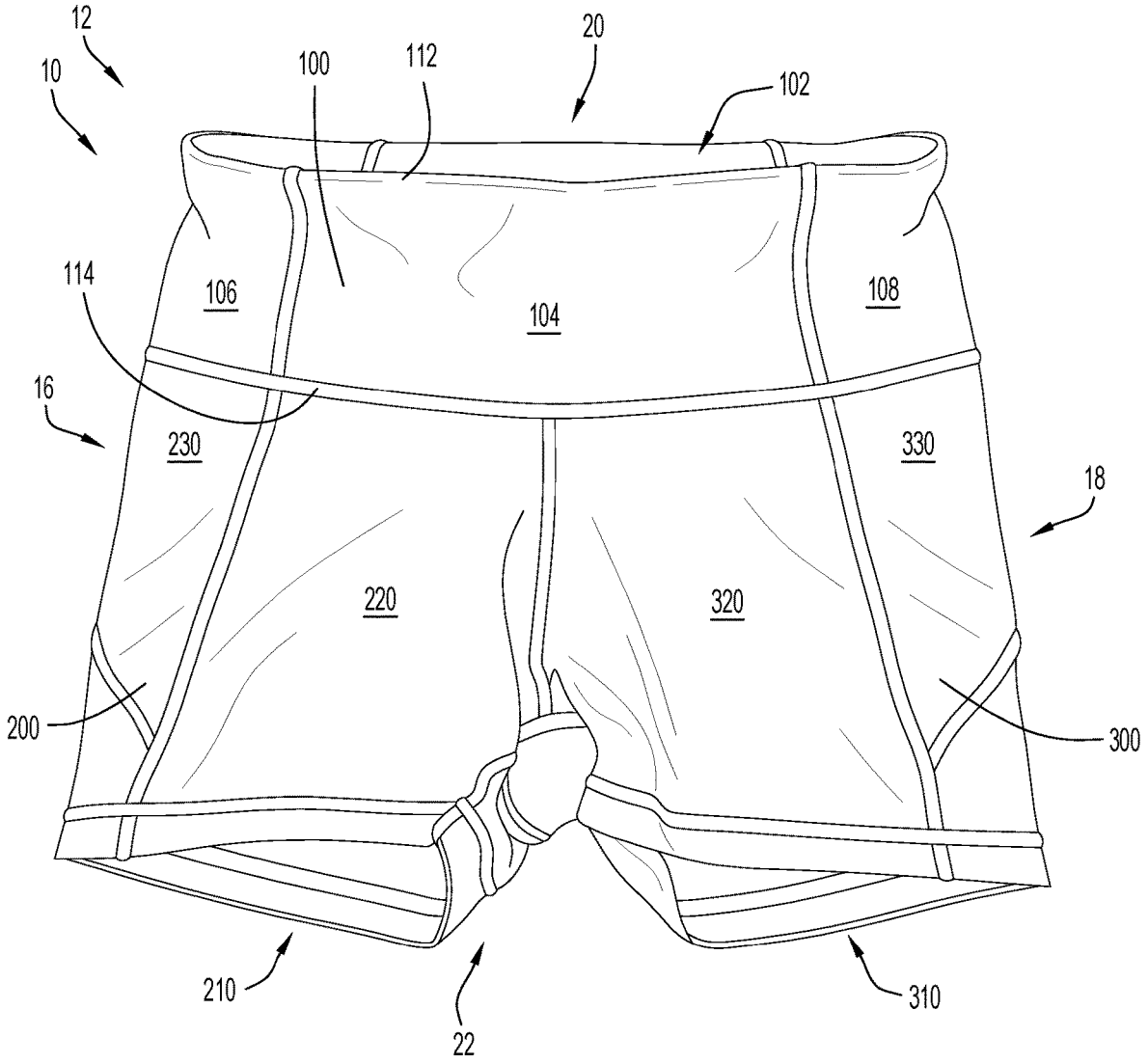
FIG. 1A illustrates a front view of a garment in accordance with an embodiment of the present invention.

In the following detailed description, reference is made to the accompanying figures which form a part hereof wherein like numerals designate like parts throughout, and in which is shown, by way of illustration, embodiments that may be practiced. It is to be understood that other embodiments may be utilized, and structural or logical changes may be made without departing from the scope of the present disclosure. Therefore, the following detailed description is not to be taken in a limiting sense, and the scope of embodiments is defined by the appended claims and their equivalents.

Aspects of the disclosure are disclosed in the accompanying description. Alternate embodiments of the present disclosure and their equivalents may be devised without parting from the spirit or scope of the present disclosure. It should be noted that any discussion herein regarding "one embodiment", "an embodiment", "an exemplary embodiment", and the like indicate that the embodiment described may include a particular feature, structure, or characteristic, and that such particular feature, structure, or characteristic may not necessarily be included in every embodiment. In addition, references to the foregoing do not necessarily comprise a reference to the same embodiment. Finally, irrespective of whether it is explicitly described, one of ordinary skill in the art would readily appreciate that each of the particular features, structures, or characteristics of the given embodiments may be utilized in connection or combination with those of any other embodiment discussed herein.

Various operations may be described as multiple discrete actions or operations in turn, in a manner that is most helpful in understanding the claimed subject matter. However, the order of description should not be construed as to imply that these operations are necessarily order dependent. In particular, these operations may not be performed in the order of presentation. Operations described may be performed in a different order than the described embodiment. Various additional operations may be performed and/or described operations may be omitted in additional embodiments.

For the purposes of the present disclosure, the phrase "A and/or B" means (A), (B), or (A and B). For the purposes of the present disclosure, the phrase "A, B, and/or C" means (A), (B), (C), (A and B), (A and C), (B and C), or (A, B and C).

The terms "comprising," "including," "having," and the like, as used with respect to embodiments of the present disclosure, are synonymous.

Referring to FIGS. 1A, 1B, 2A, 2B, 3, and 4, illustrated is an embodiment of a garment that can be worn by a person, where the garment includes a tension closure pocket. The embodiment of the garment illustrated is a pair of pants 10. The term pants may refer to any type of bottom typically worn by people, including, but not limited to, pants, knickers, capris, shorts, trousers, skirts, kilts, etc. The pants 10 contain a front side 12, and a rear side 14, the rear side 14 oriented opposite of the front side 12. The pants 10 further include a first (e.g., right) side 16 connecting the front side 12 to the rear side 14. The pants 10 also include a second (e.g., left) side 18 that is oriented opposite of the first side 16 and that also connects the front side 12 to the rear side 14. The pants further include a top side 20 and a bottom side 22 oriented opposite of the top side 20.

As described herein, the pants 10 can be constructed of any suitable elastomeric fabric materials, including elastomeric fabrics that provide two-way stretch or four-way stretch characteristics so as to provide a form-fitting or compression fit against the user's body. Elastomeric fabrics can be formed from yarns, fibers and/or filaments using any suitable types of elastomeric and/or non-elastomeric components. An example of an elastomeric materials for use in forming the fabric materials for the pants are polyester-polyurethane copolymers used to form synthetic yarns, fibers or filaments and commonly referred to as spandex or elastane. Fabrics formed from yarns or fibers comprising spandex or elastane provide significant elasticity to the fabric so as to achieve a desired form or compression fit to the user's body. In addition, the pants 10 can be formed from one or a plurality of panels of fabrics as described herein.

The embodiment of the pants 10 illustrated in FIGS. 1A, 1B, 2A, 2B, 3, and 4 may contain a waist portion 100, a first leg portion 200, and a second leg portion 300. As illustrated, the waist portion 100 is disposed proximate to the top 20 of the pants 10 and extends around each of the sides 12, 14, 16, 18 of the pants 10. The first leg portion 200 is disposed proximate to the front side 12, rear side 14, and first side 16 of the pants 10. As illustrated, the first leg portion 200 extends downwardly from the waist portion 100 towards the bottom side 22 of the pants 10. The second leg portion 300 is disposed proximate to the front side 12, rear side 14, and second side 18 of the pants 10. The second leg portion 300 extends downwardly from the waist portion 100 towards the bottom side 22 of the pants 10. The first leg portion 200 may be coupled to the second leg portion 300 at a central or crotch location on the front side 12, rear side 14, and bottom side 22 of the pants 10. The waist portion 100 defines an opening 102 proximate to the top side 20 of the pants 10, where the opening 102 is configured to receive portions of the body of the user wearing the pants 10. When worn by a user, the waist portion 100 of the pants 10 is configured to encircle or surround the user proximate to the user's waist. The first leg portion 200 defines a first leg opening 210 that is configured to receive the first (e.g., right) leg of the user wearing the pants 10. The first leg opening 210 is disposed proximate to the bottom 22 and first side 16 of the pants 10 and surrounds or encircles at least a portion of the first leg (e.g., thigh, knee, calf, ankle, etc.) of the user wearing the pants 10. Similarly, the second leg portion 300 defines a second leg opening 310 that is configured to receive the second (e.g., left) leg of the user wearing the pants 10. The second leg opening 310 is disposed proximate to the bottom 22 and second side 18 of the pants 10, and is configured to surround or encircle at least a portion of the second leg (e.g., thigh, knee, calf, ankle, etc.) of the user wearing the pants 10.

Figure 1B:
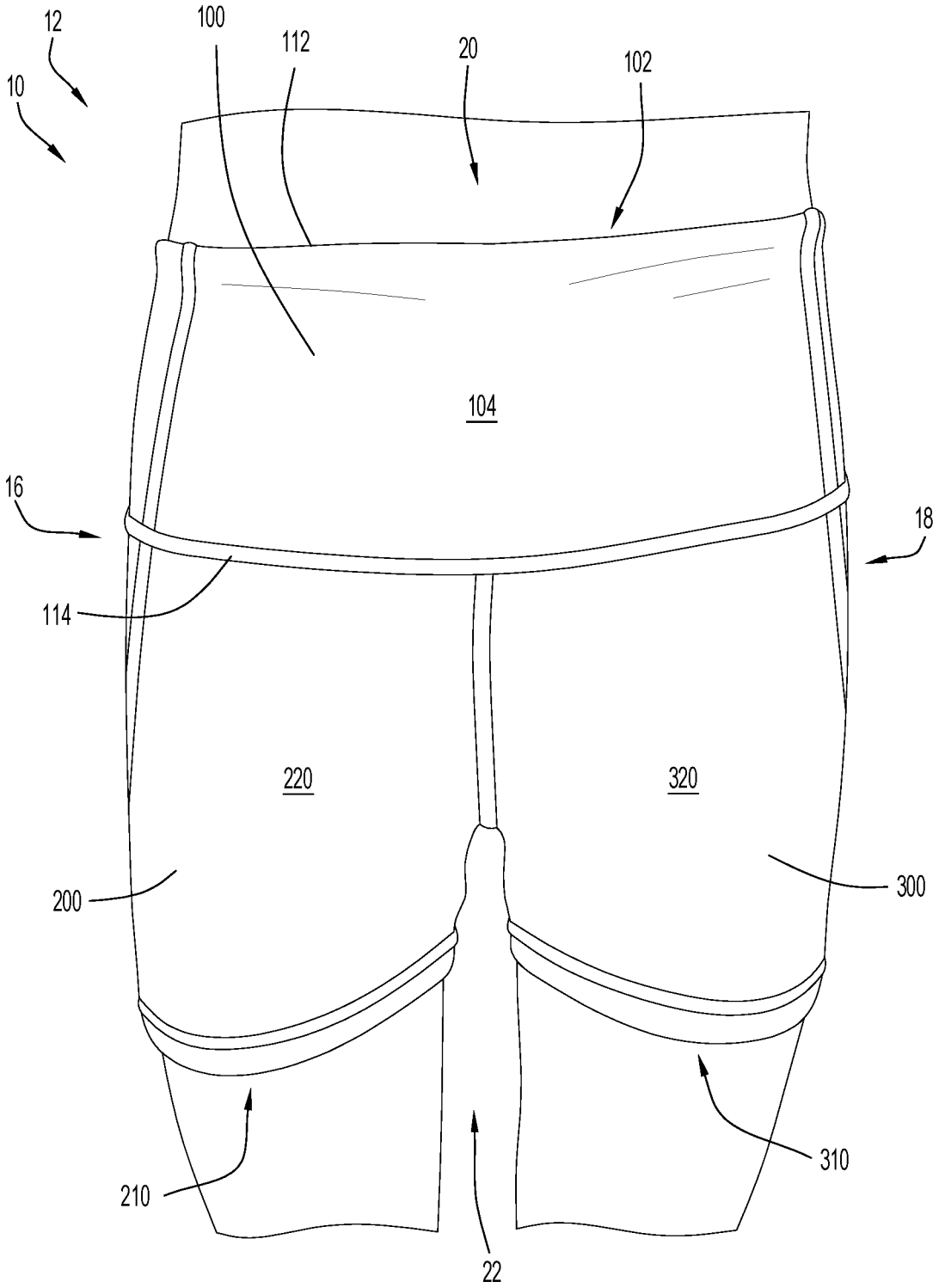
FIG. 1B illustrates a front view of the embodiment of the garment illustrated in FIG. 1A while being worn by a user.
Figure 2A:
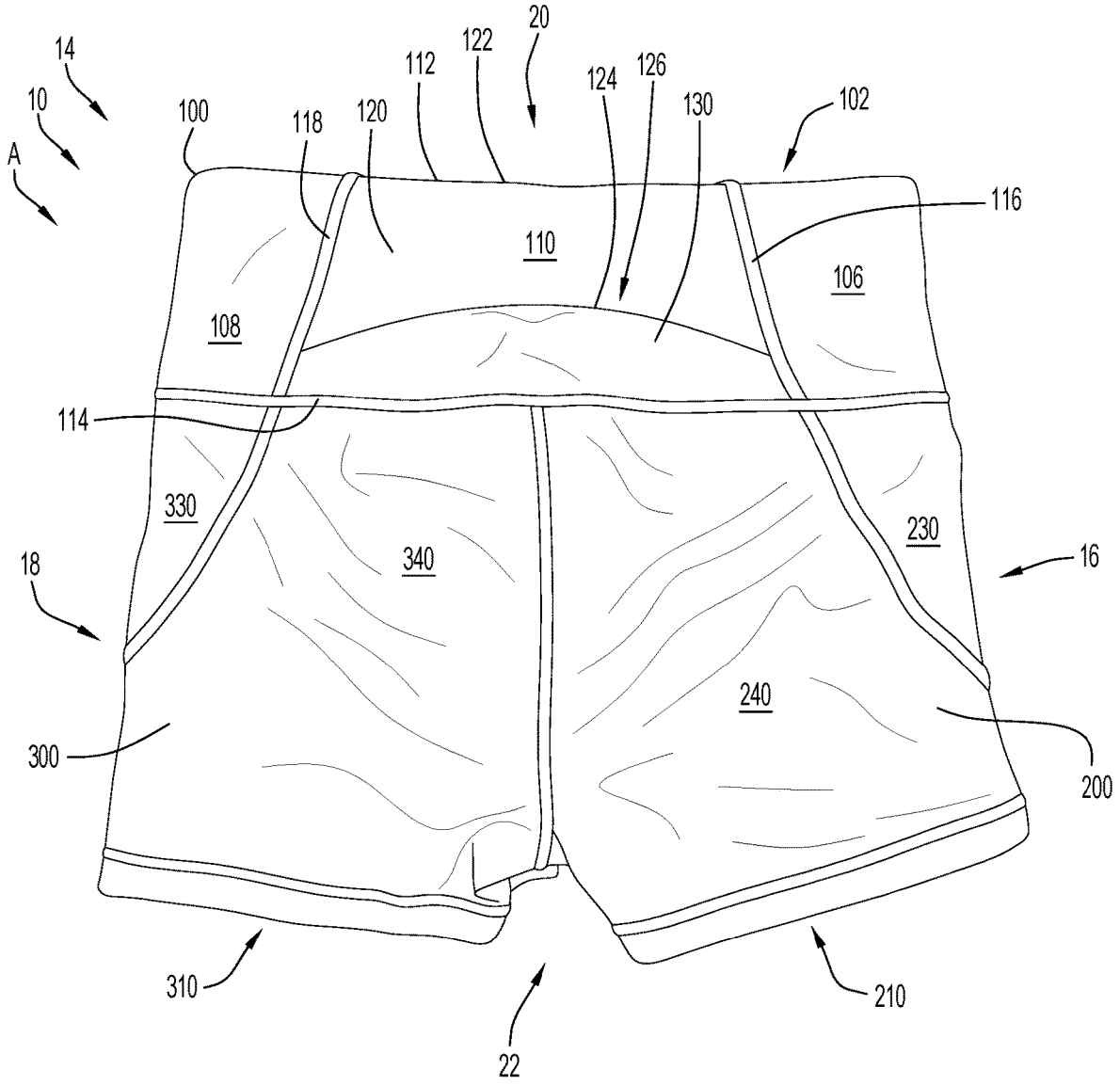
FIG. 2A illustrates a rear view of the embodiment of the garment illustrated in FIG. 1A.
Figure 2B:
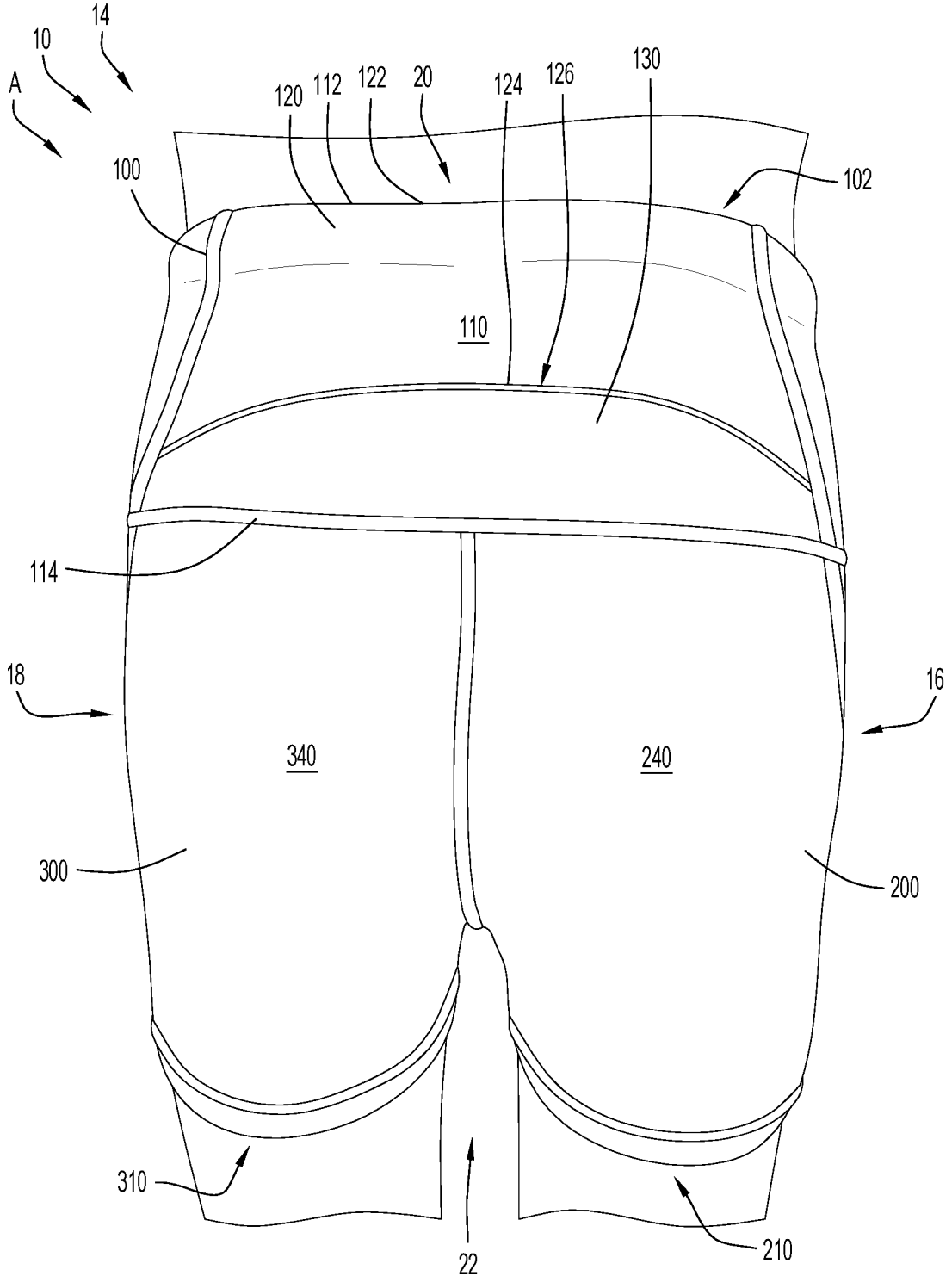
FIG. 2B illustrates a rear view of the embodiment of the garment illustrated in FIG. 1A while being worn by a user.
Figure 3:
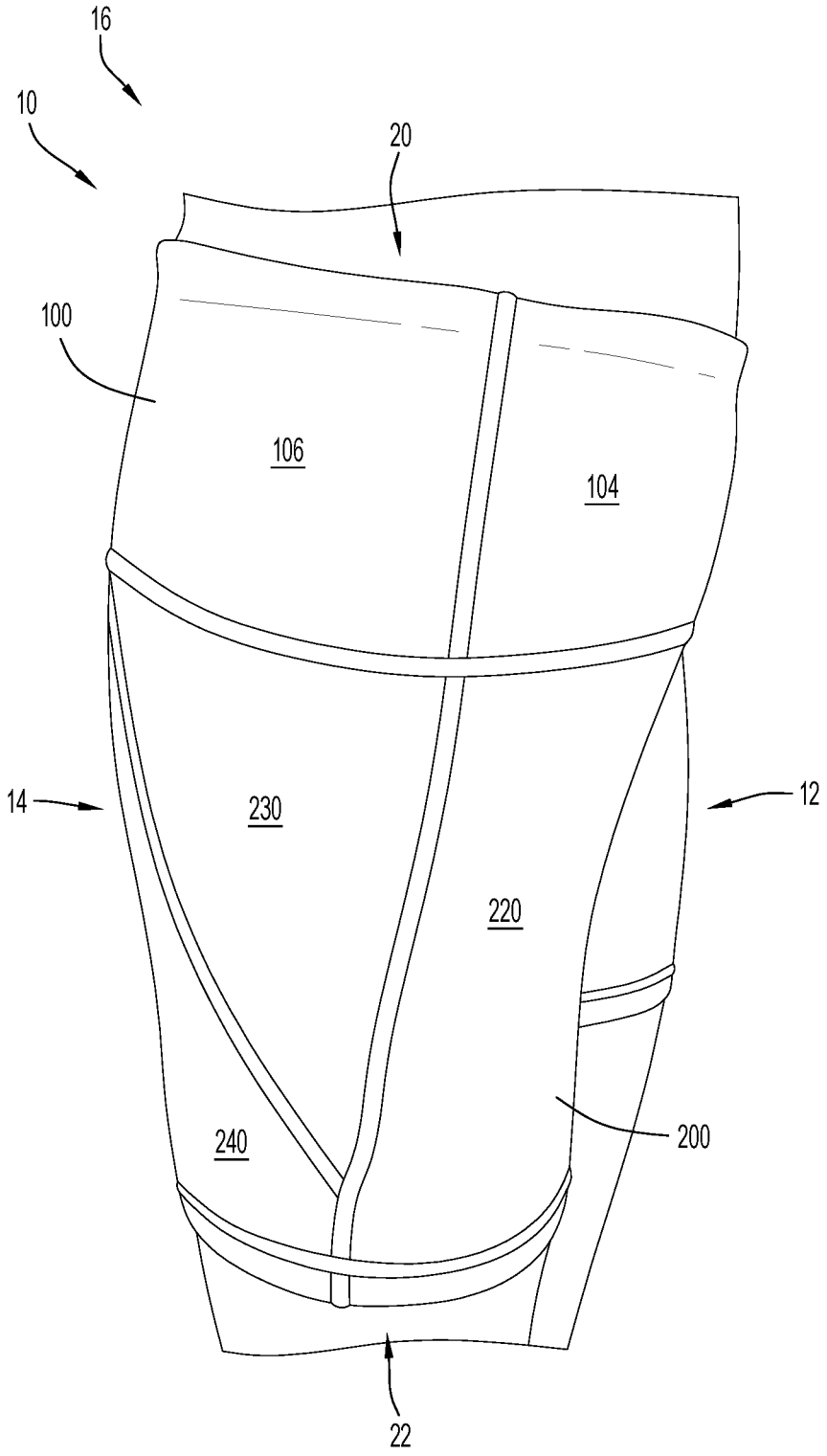
FIG. 3 illustrates a side view of a first side (e.g., right side) of the embodiment of the garment illustrated in FIG. 1A while the garment is being worn by a user.
Figure 4:
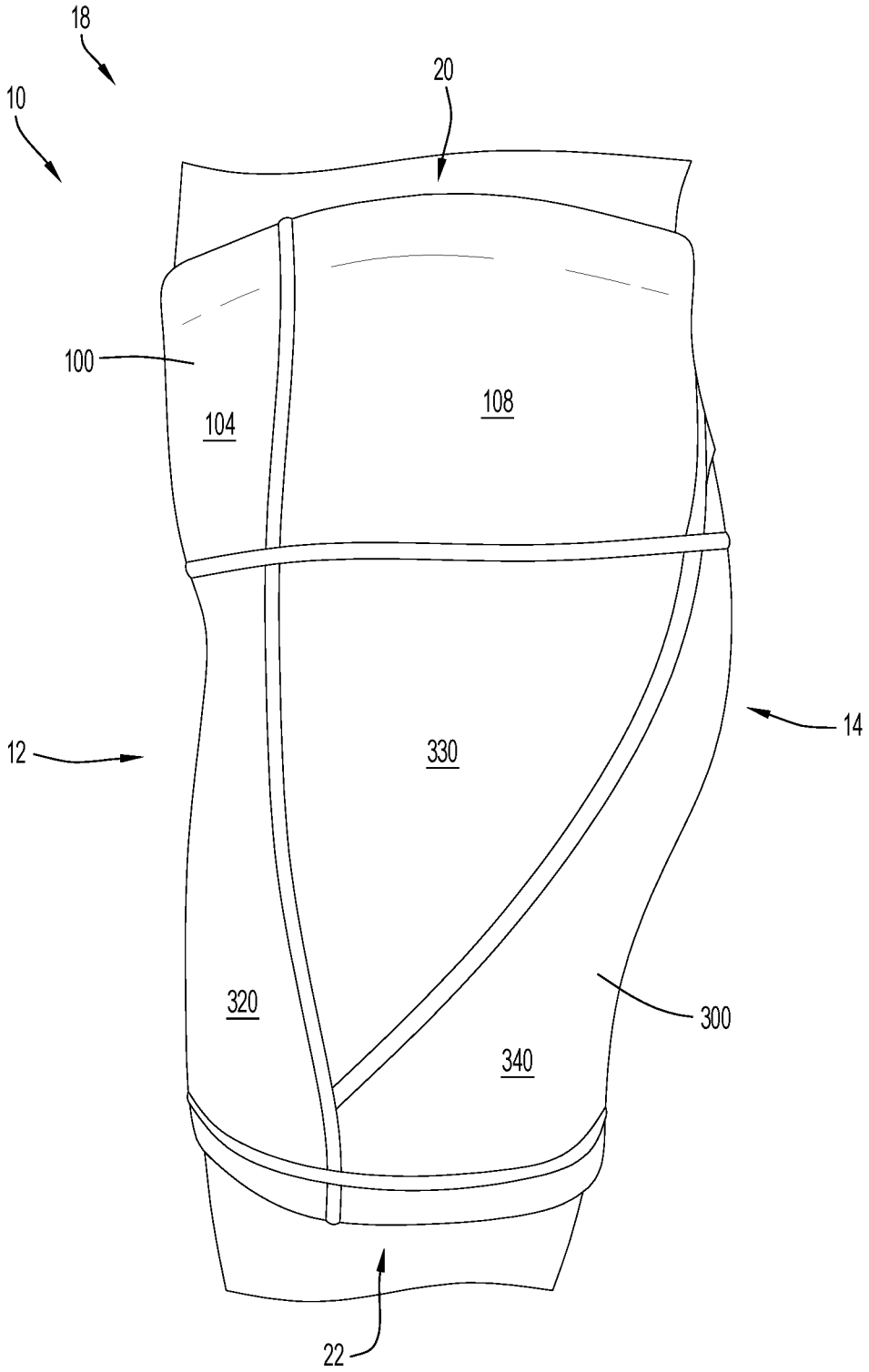
FIG. 4 illustrates a side view of a second side (e.g., left side) the embodiment of the garment illustrated in FIG. 1A while the garment is being worn by the user.
Figure 5:
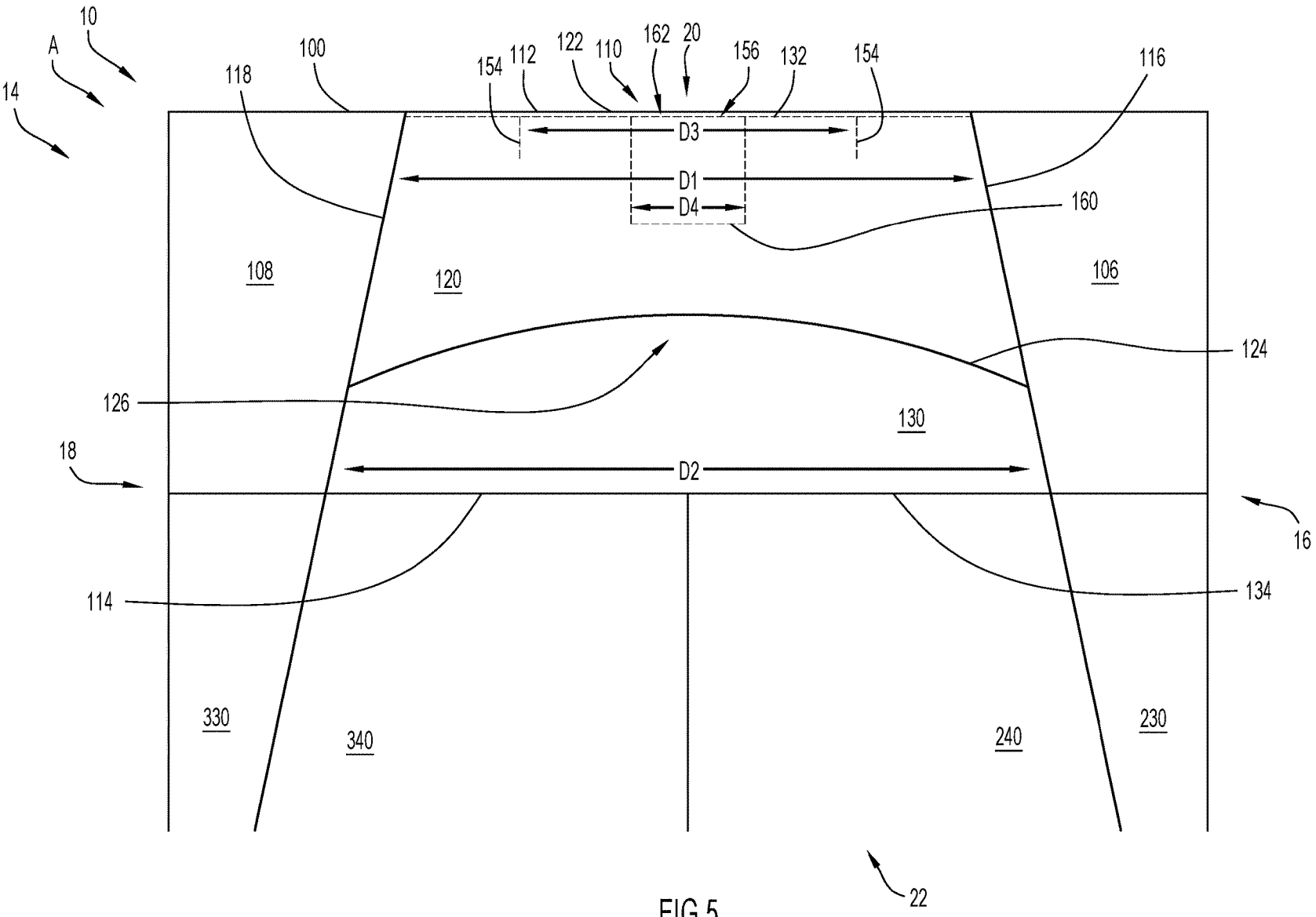
FIG. 5 illustrates a schematic view of the pocket of the embodiment of the garment illustrated in FIG. 1A.

As further illustrated in FIGS. 1A, 1B, 2A, 2B, 3, and 4, the waist portion 100 is constructed of a first fabric panel 104, a second fabric panel 106, a third fabric panel 108, and a fourth fabric panel 110. The first fabric panel 104 may be centrally oriented on the front side 12 of the pants 12, with the second fabric panel 106 being disposed primarily on the first side 16 of the pants 10 and the third fabric panel 108 being disposed primarily on the second side 18 of the pants 10. The first fabric panel 104 may be coupled to the second fabric panel 106 and the third fabric panel 108. As best illustrated in FIGS. 2A and 2B, the fourth fabric panel 110 may be disposed centrally on the rear side 14 of the pants 10 and coupled to the second and third fabric panels 106, 108. The panels 104, 106, 108, 110 collectively define a top edge 112 of the waist portion 100 and a bottom edge 114 of the waist portion 100, where the bottom edge 114 of the waist portion 100 is disposed opposite of the top edge 112. The fourth fabric panel 110 is coupled to the second fabric panel 106 via a first seam 116 and is coupled to the third fabric panel 108 via a second seam 118. Thus, the fourth fabric panel 110 is defined by the top edge 112 of the waist portion 100, the bottom edge 114 of the waist portion, the first seam 116 and the second seam 118. As best illustrated in FIGS. 2A, 2B, and 5, the first and second seams 116, 118 are angled such that the first and second seams 116, 118 are converging towards one another proximate to the top 20 of the pants 10. The width D1 of the fourth fabric panel 110 proximate the top edge 112 of the waist portion 100 is shorter in length than the width D2 of the fourth fabric panel 110 proximate to the bottom edge 114 of the waist portion 100. Thus, as illustrated, the fourth fabric panel 110 is substantially trapezoidal.

The fabric panels 104, 106, 108, 110 may be coupled to one another via stitching, such as, but not limited to, flatlock stitching, overlock stitching, blind stitching, etc. In addition, the fabric panels 104, 106, 108, 110 may be coupled to one another by means other than stitching, such as, but not limited to, bonding, adhesives, etc. In other embodiments of the pants 10, the waist portion 100 may be formed from any number of fabric panels. Additionally, the fabric panels 104, 106, 108, 110 may be constructed from a blend of nylon and spandex (a polyester-polyurethane copolymer). In one embodiment, the fabric panels 104, 106, 108, 110 may be constructed from a warp knit blend of 71% nylon and 29% elastane. Thus, the panels 104, 106, 108, 110 of the waist portion 100 are resilient/elastomeric and are configured to stretch, deform, and take the shape of a portion of the body (e.g., the waist) of the user wearing the pants 10. In other embodiments of the pants 10, however, the fabric panels 104, 106, 108, 110 of the waist portion 100 may be constructed from other types of fabric that enable the waist portion 100 to stretch and deform to the body of the user wearing the pants 10.

In the embodiment illustrated, the first leg portion 200 is constructed of a first fabric panel 220, a second fabric panel 230, and a third fabric panel 240. The first leg portion 200 is coupled to the bottom edge 114 of the waist portion 100 such that the first leg portion 200 extends downward from the waist portion 100. As illustrated in FIGS. 1A and 1B, the first fabric panel 220 of the first leg portion 200 is disposed on the front side 12 of the pants 10. As illustrated in FIGS. 2A and 2B, the third fabric panel 240 of the first leg portion 200 is disposed on the rear side 14 of the pants 10. FIG. 3 best illustrates that the second fabric panel 230 is disposed on the first side 16 of the pants 10 and is coupled to the first and second fabric panels 220, 240. In addition, FIG. 3 illustrates that, proximate the bottom 22 of the pants 10 on the first side 16, the first panel 220 is also coupled to the third panel 240. The fabric panels 220, 230, 240 of the first leg portion 200 may be coupled to one another via stitching, such as, but not limited to, flatlock stitching, overlock stitching, blind stitching, etc. Furthermore, the fabric panels 220, 230, 240 of the first leg portion 200 may be coupled to one another by means other than stitching, such as, but not limited to, bonding, adhesives, etc. In other embodiments of the pants 10, the first leg portion 200 may be formed from any number of fabric panels. Similar to the fabric panels 104, 106, 108, 110 of the waist portion 100, the fabric panels 220, 230, 240 may be constructed from a blend of nylon and spandex. In one embodiment, the fabric panels 220, 230, 240 may be constructed from a warp knit blend of 71% nylon and 29% elastane. Thus, the panels 220, 230, 240 of the first leg portion 200 are resilient/elastomeric and are configured to stretch, deform, and take the shape of a portion of the body (e.g., the first leg) of the user wearing the pants 10. In other embodiments of the pants 10, however, the fabric panels 220, 230, 240 may be constructed from other types of fabric that enable the first leg portion 200 to stretch and deform around the first leg of the user wearing the pants 10.

Similar to the first leg portion 200, the second leg portion 300 is constructed of three fabric panels; a first fabric panel 320, a second fabric panel 330, and a third fabric panel 340. The second leg portion 300 is coupled to the bottom edge 114 of the waist portion 100 such that the second leg portion 300 extends downward from the waist portion 100. As illustrated in FIGS. 1A and 1B, the first fabric panel 320 of the second leg portion 300 is disposed on the front side 12 of the pants 10. As illustrated in FIGS. 2A and 2B, the third fabric panel 340 of the second leg portion 300 is disposed primarily on the rear side 14 of the pants 10. FIG. 4 best illustrates that the second fabric panel 330 of the second fabric portion 300 is disposed primarily on the second side 18 of the pants 10 and is coupled to the first and second fabric panels 320, 340. FIG. 4 also illustrates that, on the second side 18 of the pants 10 proximate the bottom 22, the first panel 320 is also coupled to the third panel 340. The fabric panels 320, 330, 340 of the second leg portion 300 may be coupled to one another via stitching, such as, but not limited to, flatlock stitching, overlock stitching, blind stitching, etc. In addition, the fabric panels 320, 330, 340 of the second leg portion 300 may be coupled to one another by means other than stitching, such as, but not limited to, bonding, adhesives, etc. In other embodiments of the pants 10, the second leg portion 300 may be formed from any number of fabric panels. Similar to the fabric panels 104, 106, 108, 110 of the waist portion 100 and the fabric panels 220, 230, 240 of the first leg portion 200, the fabric panels 320, 330, 340 of the second leg portion 300 may be constructed from a blend of nylon and spandex. In one embodiment, the fabric panels 320, 330, 340 may be constructed from a warp knit blend of 71% nylon and 29% elastane. Thus, the panels 320, 330, 340 of the second leg portion 300 are resilient/elastomeric and are configured to stretch, deform, and take the shape of a portion of the body (e.g., the second leg) of the user wearing the pants 10. In other embodiments of the pants 10, however, the fabric panels 320, 330, 340 may be constructed from other types of fabric that enable the second leg portion 300 to stretch and deform around the second leg of the user wearing the pants 10.

As illustrated in FIGS. 2A, 2B, 5, 6A, 6B, and 6C, the fourth panel 110 of the waist portion 100 includes a first flap 120 and a second flap 130. The first flap 120 may include a top edge 122 disposed proximate to the top 20 of the pants 10 and bottom edge 124 opposite of the top edge 122. The top edge 122 of the first flap 120 may be fixedly coupled to the top edge 112 of the waist portion 100. In addition, the sides of the first flap 120 may be fixedly coupled to the first and second seams 116, 118. The bottom edge 124 is arcuate, or, in other words, contains a curvature 126. Because of the angled first and second seams, the top edge 122 of the first flap 120 is shorter in length than the bottom edge 124 of the first flap 120, making the first flap substantially trapezoidal.

As best illustrated in FIG. 5, the second flap 130 includes a top edge 132 (shown in phantom) oriented proximate to the top 20 of the pants 10 and the top edge 112 of the waist portion 100. The top edge 132 of the second flap 130 is disposed underneath the first flap 120. Thus, the first flap 120 at least partially lies overtop the second flap 130 such that the top edge 132 of the second flap 130 is covered by the first flap 120. The second flap 130 further includes a bottom edge 134 opposite of the top edge 132, the bottom edge 134 being exposed and fixedly coupled to the bottom edge 114 of the waist portion 100. Therefore, the second flap 130 is also fixedly coupled to the third fabric panel 240 of the first leg portion 200 and the third fabric panel 340 of the second leg portion 300. As further illustrated, the second flap 130 is further fixedly coupled to the second and third panels 106, 108 of the waist portion 100 via the first seam 116 and the second seam 118, respectively. Because of the angling of the first and second seams 116, 118, the second flap 130 is also substantially trapezoidal, where the top edge 132 of the second flap 130 is approximately equal to the width D1, and the bottom edge 134 of the second flap 130 is approximately equal to the width D2, where the D2 is greater than D1.

Because the first flap 120 and the second flap 130 form part of the fourth panel 110 of the waist portion 100, similar to the fourth panel 110, the first and second flaps 120, 130 may be constructed from a blend of nylon and spandex (a polyester-polyurethane copolymer). In one embodiment, the flaps 120, 130 may be constructed from a warp knit blend of 71% nylon and 29% elastane. Thus, the flaps 120, 130 are resilient/elastomeric and are configured to stretch and deform. In other embodiments of the pants 10, however, the flaps 120, 130 of the waist portion 100 may be constructed from other types of fabric that enable the waist portion 100 to stretch and deform to the body of the user wearing the pants 10.

Figure 6A:
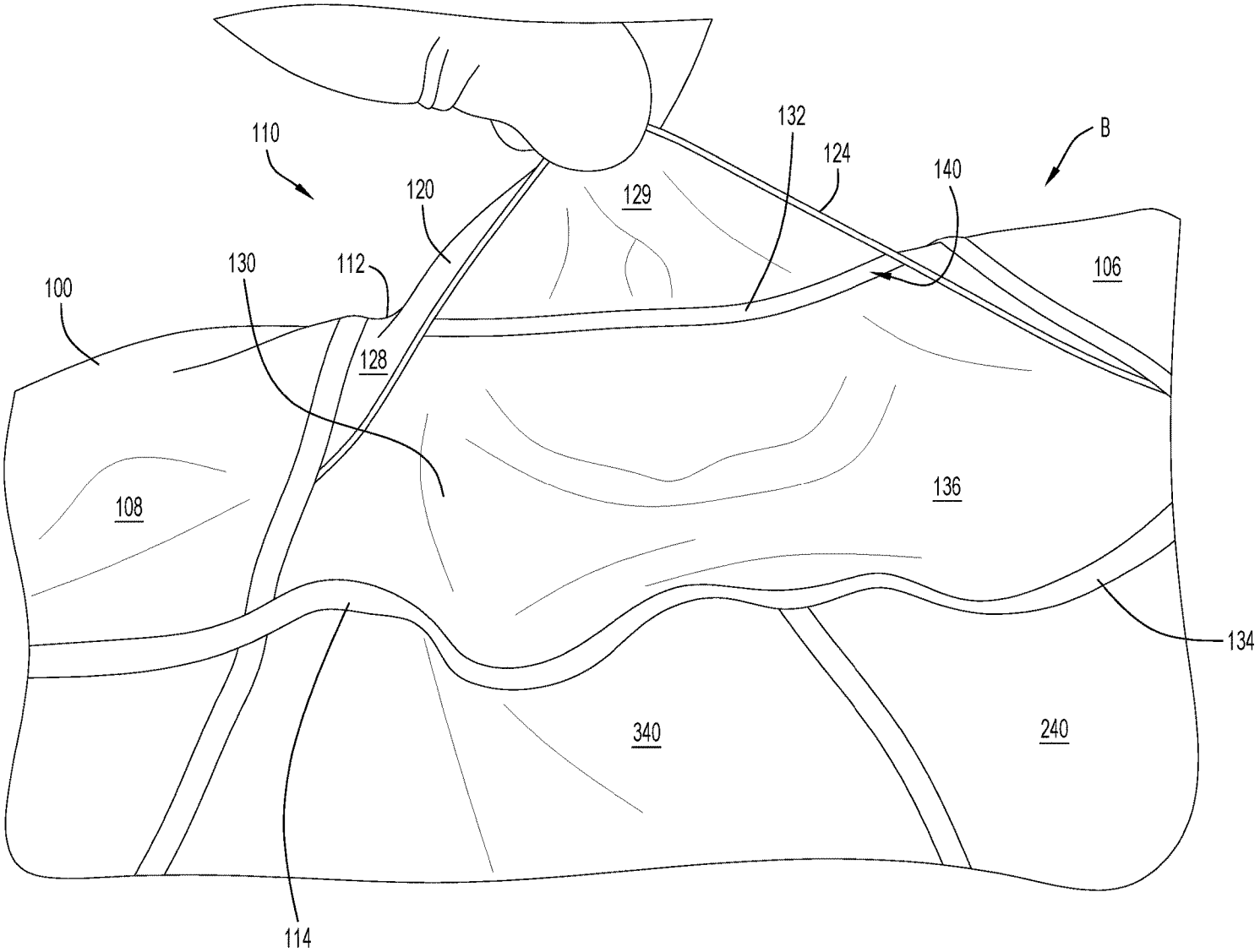
FIG. 6A illustrates an elevational view of the pocket of the embodiment of the garment illustrated in FIG. 1A being opened.
Figure 6B:
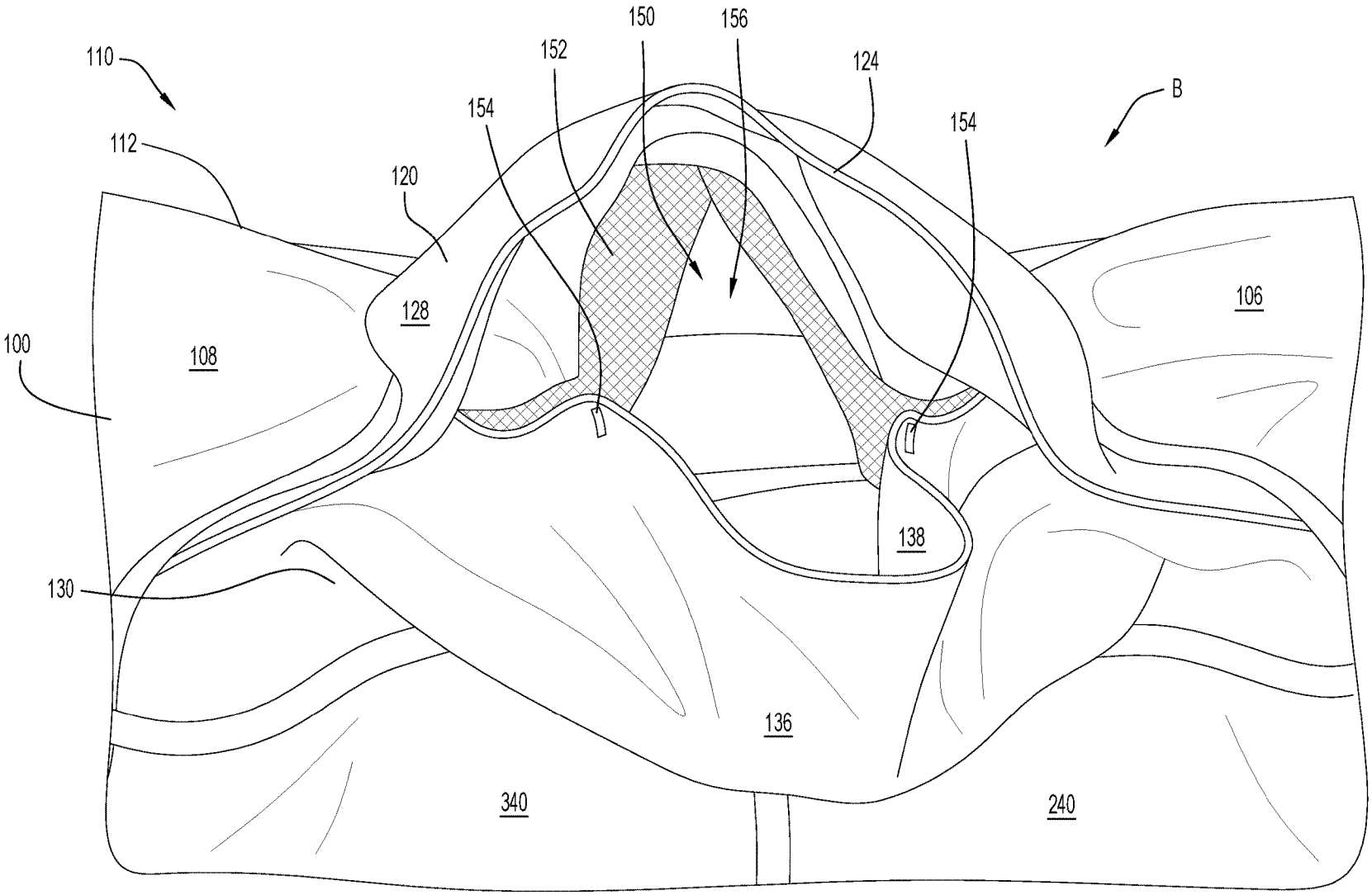
FIG. 6B illustrates a top view the interior of the pocket of the embodiment of the garment illustrated in FIG. 1A.
Figure 6C:
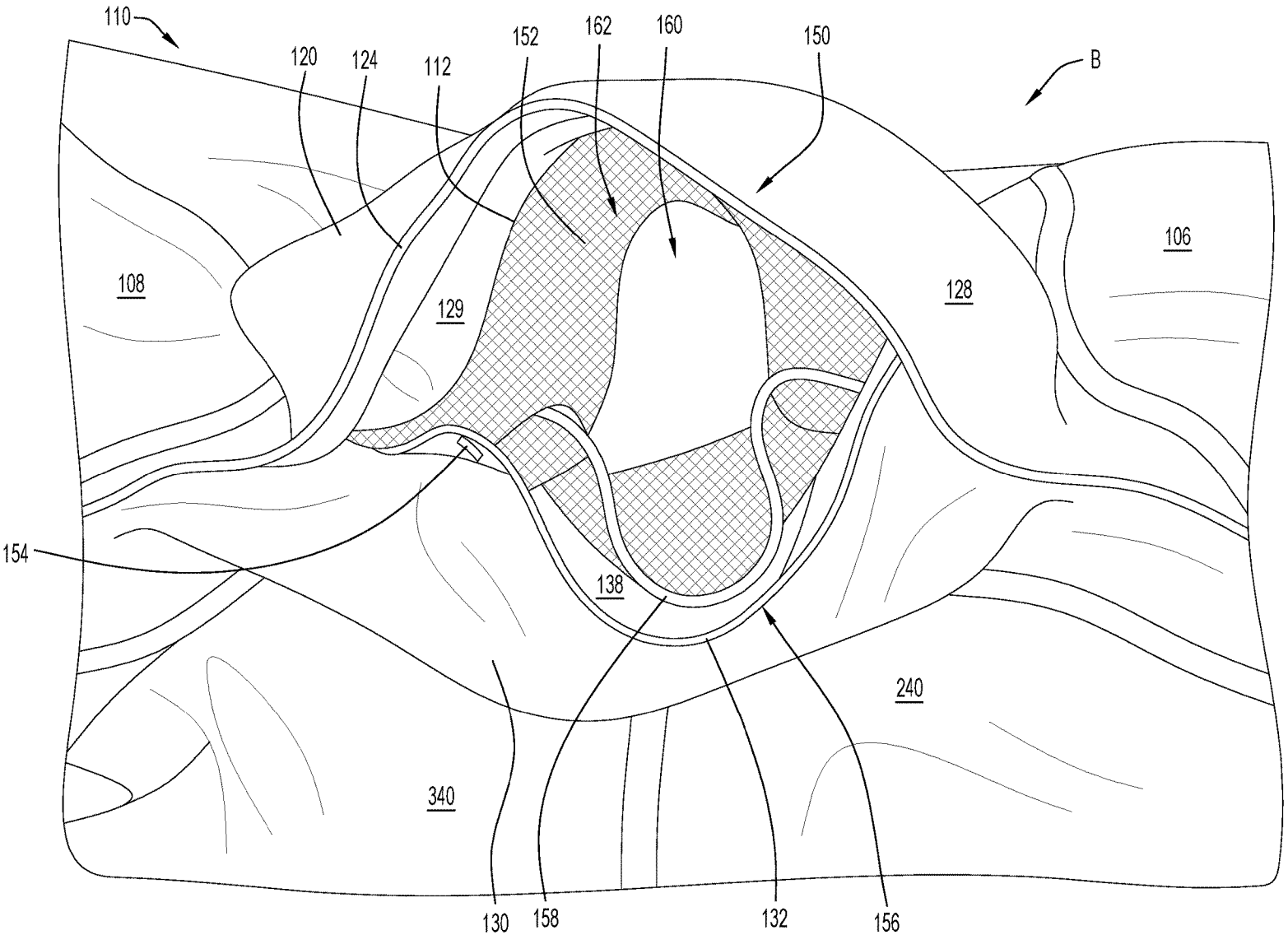
FIG. 6C illustrates a top view of the inner pocket disposed within the interior of the pocket illustrated in FIG. 6A.

FIGS. 2A, 2B, and 5 illustrate the first and second flaps 120, 130 in a closed position A, while FIGS. 6A, 6B, and 6C illustrate the first and second flaps 120, 130 in various states of an open position B. As best illustrated in FIGS. 6A, 6B and 6C, the first flap 120 has an exterior surface 128 and an interior (user facing) surface 129. Similarly, the second flap 130 has an exterior surface 136 and an interior (user facing) surface 138. When in the closed position A, the first flap 120 lies at least partially over the second flap 130, such that the interior surface 129 of the first flap 120 abuts against, contacts, or is adjacent to the exterior surface 136 of the second flap 130. Additionally, when in the closed position A, the bottom edge 124 of the first flap 120 is oriented lower than the top edge 132 of the second flap 130, such that the first flap 120 covers the top edge 132 of the second flap 130. In other words, in the closed position A, the top edge 132 of the second flap 130 is oriented closer to the top edge 112 of the waist portion 100 than the bottom edge 124 of the first flap 120, which overlies the second flap 130. When in the open position B, however, the first flap 120 is at least partially pulled away from the second flap 130, such that at least a portion of the interior surface 129 of the first flap 120 is disposed or spaced away from the exterior surface 136 of the second flap 130. Thus, in the open position B, at least a portion of the interior surface 129 of the first flap 120 is oriented farther away from the exterior surface 126 of the second flap 130 than when in the closed position A.

Once the first flap 120 is oriented to the open position B, as illustrated in FIG. 6A, an opening 140 is created by the first flap 120 and the second flap 130. The opening 140 provides access to the top edge 132 of the second flap 130, which can be pulled downward to access a pocket 150. The bottom edge 124 of the first flap 120 may be pulled closer to the top edge 112 of the waist portion 100, while the top edge 132 of the second flap 130 may be pulled downward, away from the top edge 112 of the waist portion 100. Thus, the top edge 132 of the second flap 130 may be at least partially exposed in the open position B, such that the first flap 120 does not cover or overlie the entire top edge 132 of the second flap 130. By pulling the top edge 132 of the second flap 130 downward and the bottom edge 124 of the first flap 120 upward, access is provided to pocket 150.

As illustrated in FIGS. 6B and 6C, the pocket 150 includes a backing material 152, which together, with the second flap 130 defines the limits of the pocket 150. In the embodiment illustrated, the backing material 152 is constructed from a mesh fabric that has a resiliency or elasticity similar to that of the panels 104, 106, 108, 110 of the waist portion 100 of the pants 10. Thus, the backing material 152 may also be configured to stretch and deform with the panels 104, 106, 108, 110 of the waist portion 100. In another embodiment, the backing material 152 may be constructed from other types of fabric, and the backing material 152 may not be resilient/elastic and configured to stretch like that of the panels 102, 104, 106, 108 of the waist portion 100. The backing material 152 may be fixedly coupled to the top edge 122 of the first flap 120 and the top edge 112 of the waist portion 100 proximate to the top 20 of the pants 10. While not illustrated, the backing material 152 may also be fixedly coupled to the bottom edge 114 of the waist portion 100 and the first and second angled seams 116, 118 that couple the second and third panels 106, 108 of the waist portion 100 to the first and second flaps 120, 130 of the fourth panel 110 of the waist portion.

As further illustrated in FIGS. 5 and 6B, the second flap 130 is coupled to the backing material 152 via two sets of stitching 154 at locations that are proximate to the top edge 132 of the second flap 130. The two sets of stitching 154 are spaced apart from one another to create an aperture 156 that provides access to the pocket 150. Thus, the aperture 156 of the pocket 150 is disposed proximate to the top edge 132 of the second flap 130, which is covered by the first flap 120 when the flaps 120, 130 are in the closed position A. Therefore, when in the closed position A, the first flap 120 also covers the aperture 156 of the pocket 150. The aperture 156 may have a width or diameter D3 that is defined by the space between the two sets of stitching 154. The width D3 of the opening is smaller in size than the width D1 of the top edge 122 of the first flap 120, which is smaller than the width of the bottom edge 124 of the first flap 120. Thus, the first flap 120 is not only disposed over the aperture 156 of the pocket 150, the first flap 120 is also wider than the aperture 156 of the pocket 150. In addition to defining the aperture 156 of the pocket 150, the two sets of stitching 154 further retain the top edge 132 of the second flap 130 in position under the first flap 120 and proximate to the top edge 112 of the waist portion 100. This prevents the second flap 130 from being reconfigured to cover the first flap 120, and aids in preventing items positioned within the pocket 150 from falling out of the pocket 150.

As best illustrated in FIG. 5, the pocket 150 is substantially equivalent to the size and shape of the second flap 130, and consequently, the fourth panel 110. The pocket 150, which is defined by and disposed between the backing material 152 and the second flap 130, spans from the top edge 112 of the waist portion 100 to the bottom edge 114 of the waist portion 100, and between the first and second angled seams 116, 118 that couple the third and fourth panels 106, 108 to the first and second flaps 120, 130 of the fourth panel 110. Thus, the pocket 150 is substantially trapezoidal. The pocket 150 may be sized and shaped to receive and securely retain small personal items, such as portable electronic devices (i.e., smartphones), keys, credit cards, identifications, etc.

FIGS. 5 and 6C best illustrate that the pocket 150 further includes a divider panel 158 that is coupled to the backing material 152 of the pocket 150. The divider panel 158 and a portion of the backing material 152 together define a smaller, inner pocket 160 disposed within the pocket 150. The divider panel 158 is coupled to the backing panel 152 on three sides of the divider panel 158 (first side, second side, and bottom), leaving an aperture 162 proximate to the aperture 156 of the pocket 150. The aperture 162 of the inner pocket 160 provides access to the inner pocket 160. The divider panel 158 may be coupled to the backing panel 152 such that the aperture 162 of the inner pocket 160 is disposed just within the aperture 156 of the pocket 150. Thus, the inner pocket 160 is only visible once the aperture 156 of the pocket 150 is opened, and when in the closed position A, the first flap 120, which covers the aperture 156 of the pocket 150 and the top edge 132 of the second flap 130, also covers the aperture 162 of the inner pocket 160. As best illustrated in FIG. 5, the inner pocket 160 may be disposed in the pocket 150 equidistant from the first and second seams 116, 118 and equidistant from the two sets of stitching 154 that define the aperture 156 of the pocket 150. Thus, the inner pocket 160 may be centrally disposed within the aperture 156 of the pocket 150. The inner pocket 160, moreover, may have a width D4 that may be significantly smaller than the width D3 of the aperture 156 of the pocket 150. Furthermore, the depth of the inner pocket 160 may only extend partially into the pocket 150, and may not extend the full distance between the top edge 132 of the second flap 130 and the bottom edge 134 of the second flap 130. This size and shape of the inner pocket 160 enables a more convenient storage location of smaller personal items, such as a key. The inner pocket 160 allows a wearer of the pants 10 to store smaller personal items within the pocket 150, but in a location within the pocket 150 that allows the user to more easily locate the smaller items.

The divider panel 158 may be constructed from a mesh fabric similar to that of the backing material 152, such that the divider panel 158 also has a resiliency or elasticity similar to that of the panels 104, 106, 108, 110 of the waist portion 100 of the pants 10. In other embodiments, the divider panel 158 may also be configured to stretch and deform with the panels 104, 106, 108, 110 of the waist portion 100. In another embodiment, the divider panel 158 may be constructed from other types of fabric that provide the same amount of elasticity. In yet another embodiment, the divider panel 158 may be constructed from a fabric that is not as resilient/elastic as that of the panels 102, 104, 106, 108 of the waist portion 100.

The stretchable and resilient nature of the first flap 120, along with the first flap 120 at least partially overlying the second flap 130 creates a tension closure pocket 150. Because the first flap 120 is disposed over the second flap 130 such that the bottom edge 124 of the first flap 120 is oriented lower than the top edge 132 of the second flap 130 when the first and second flaps 120, 130 are in their closed position A, the first flap 120 serves as a cap, lid, or cover for the pocket 150 and inner pocket 160. As previously explained, when the pants 10 are worn by a wearer, the waist portion 100 is stretched and/or deformed outwardly or laterally. More specifically, when the waist portion 100 is stretched and/or deformed laterally, the opening 102 formed by the waist portion 100 increases in diameter. The lateral stretching of the waist portion 100 causes the first flap 120 to also stretch laterally. Because the first flap 120 is fixedly coupled to the top edge 112 of the waist portion and the first and second seams 116, 118, the lateral stretching of the first flap 120 creates a tension closure over the second flap 130 and the pockets 150, 160. Because of the first and second seams 116, 118, the lateral stretching of the waist portion 100 creates opposing tensile forces that press the first flap 120 against the second flap 130. In other words, the opposing tensile forces cause the interior surface 129 of the first flap 120 to abut or contact the exterior surface 136 of the second flap 130. As the amount or degree of stretching of the waist portion 100 in the outward or lateral direction increases, the amount of the opposing tensile forces that act on the first flap 120 also increases. Thus, the greater the amount of stretching of the waist portion 100, the stronger the amount of tension in the first flap 120 that keeps the first flap 120 pressed against the second flap 130 to secure items within the pockets 150, 160. That is to say, as the lateral load on the waist portion 100 increases, the forces that force the first flap 120 to lock down onto the second flap 130, cover the aperture 156 of the pocket 150, and secure items within the pocket 150 also increase.

The first and the second flaps 120, 130, the backing material 152, and the divider panel 158, may together act as an adaptable and dynamic pocket system. Because each of the first and the second flaps 120, 130, the backing material 152, and the divider panel 158 are constructed from materials with the same or similar degrees of resiliency, the pocket 150 is adaptable to the person wearing the pants 10 and the items stored within the pocket 150 of the pants 10. Because of the resilient nature of the flaps 120, 130, the backing material 152, and the divider panel 158, as the lateral load on the waist portion 100 increases, the opposing tensile forces on these components 120, 130, 152, 158 also increases, causing these components 120, 130, 152, 158 to stretch laterally. These components 120, 130, 152, 158, however, are configured to stretch simultaneously, or in unison, so that the first flap 120 still serves as a tension closure to the pockets 150, 162. As previously explained, as the amount or degree of stretching of the waist portion 100 in the outward or lateral direction increases, the opposing tensile forces that act on the components 120, 130, 152, 158 also increases.

Figure 7A:
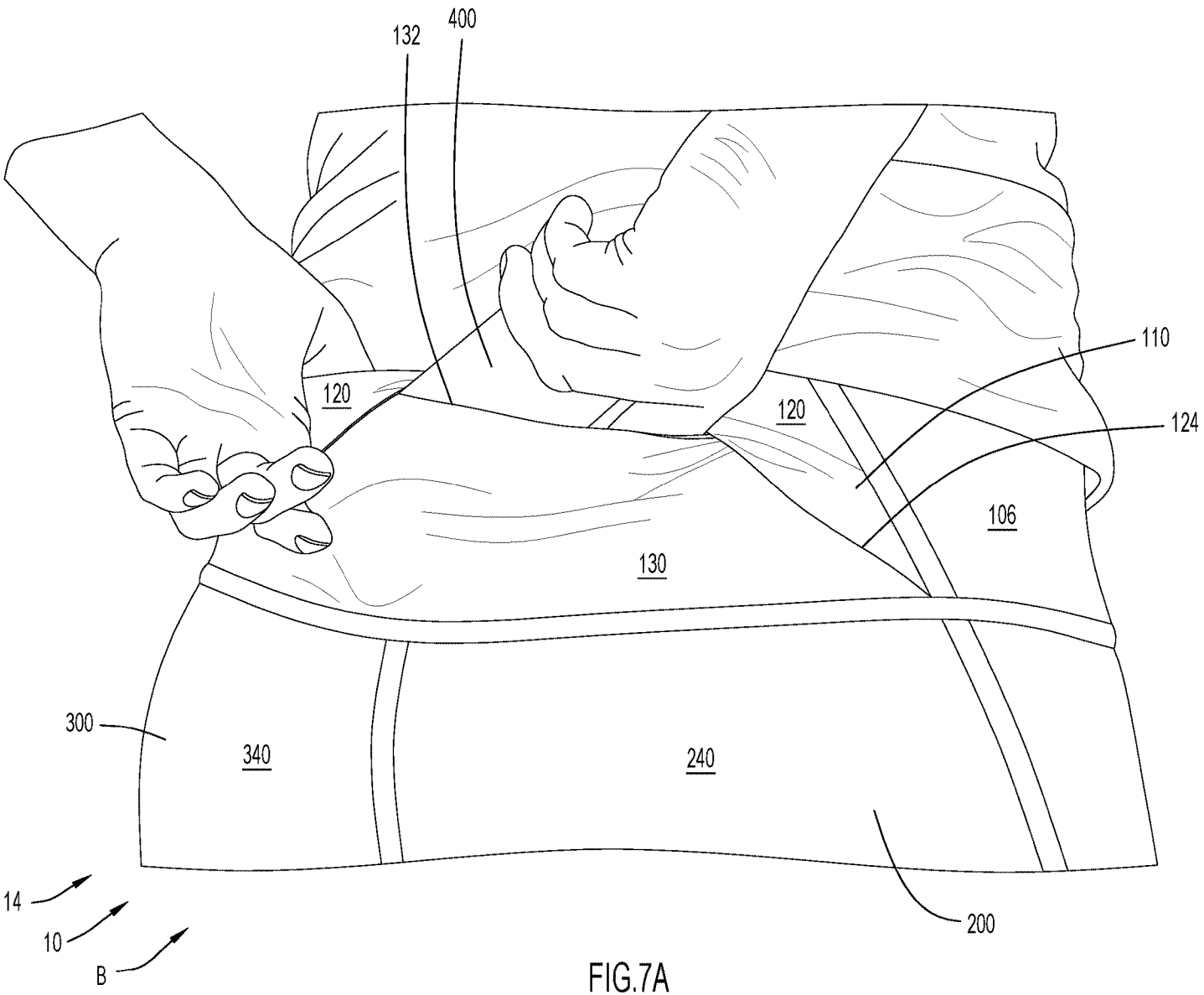
FIG. 7A illustrates a rear view of the embodiment of the garment illustrated FIG. 1A while being worn and an item being placed in the pocket of the garment.
Figure 7B:
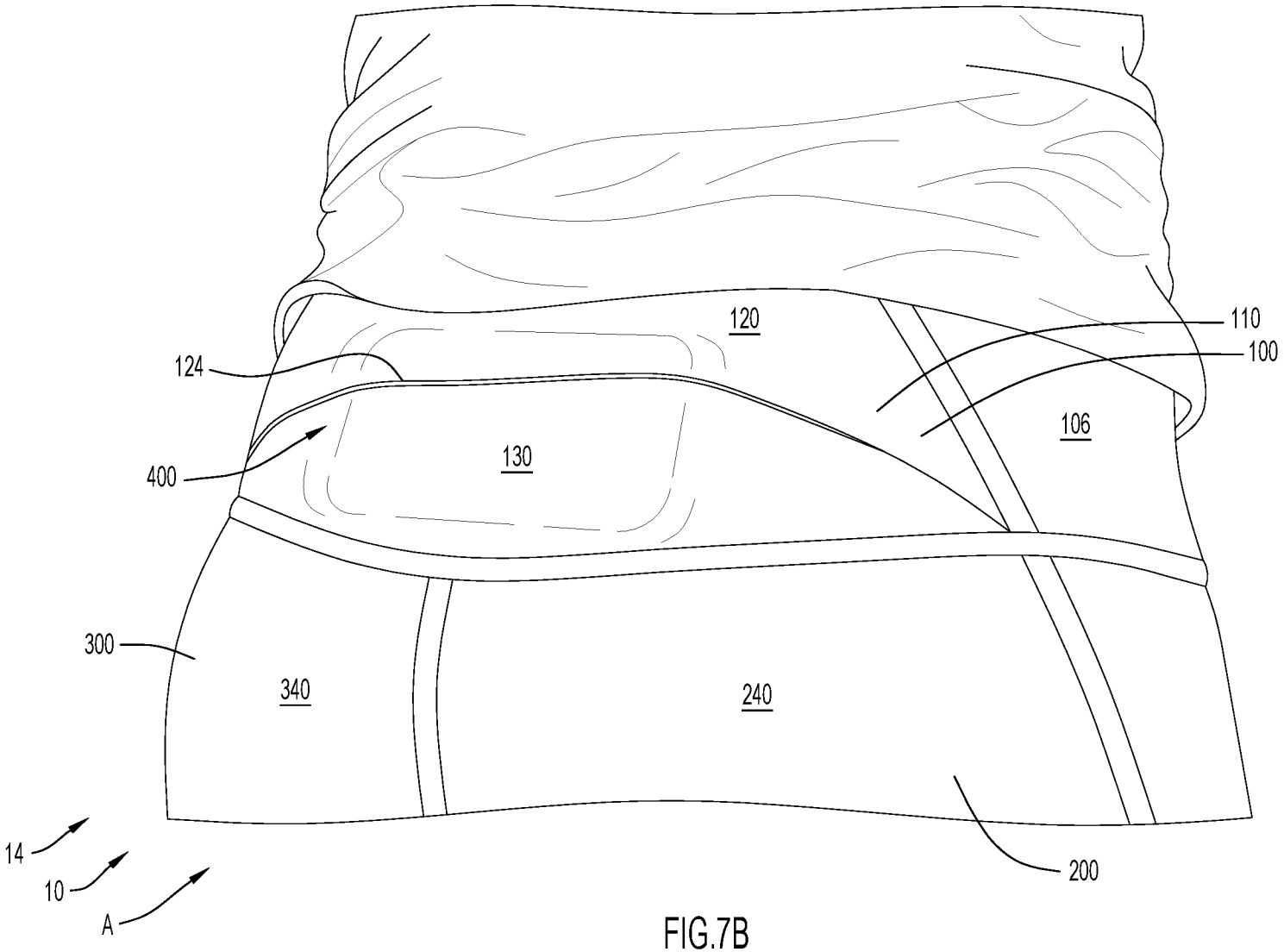
FIG. 7B illustrates a rear view of the embodiment of the garment illustrated FIG. 1A while being worn and an item disposed in the pocket of the garment.
Figure 8:
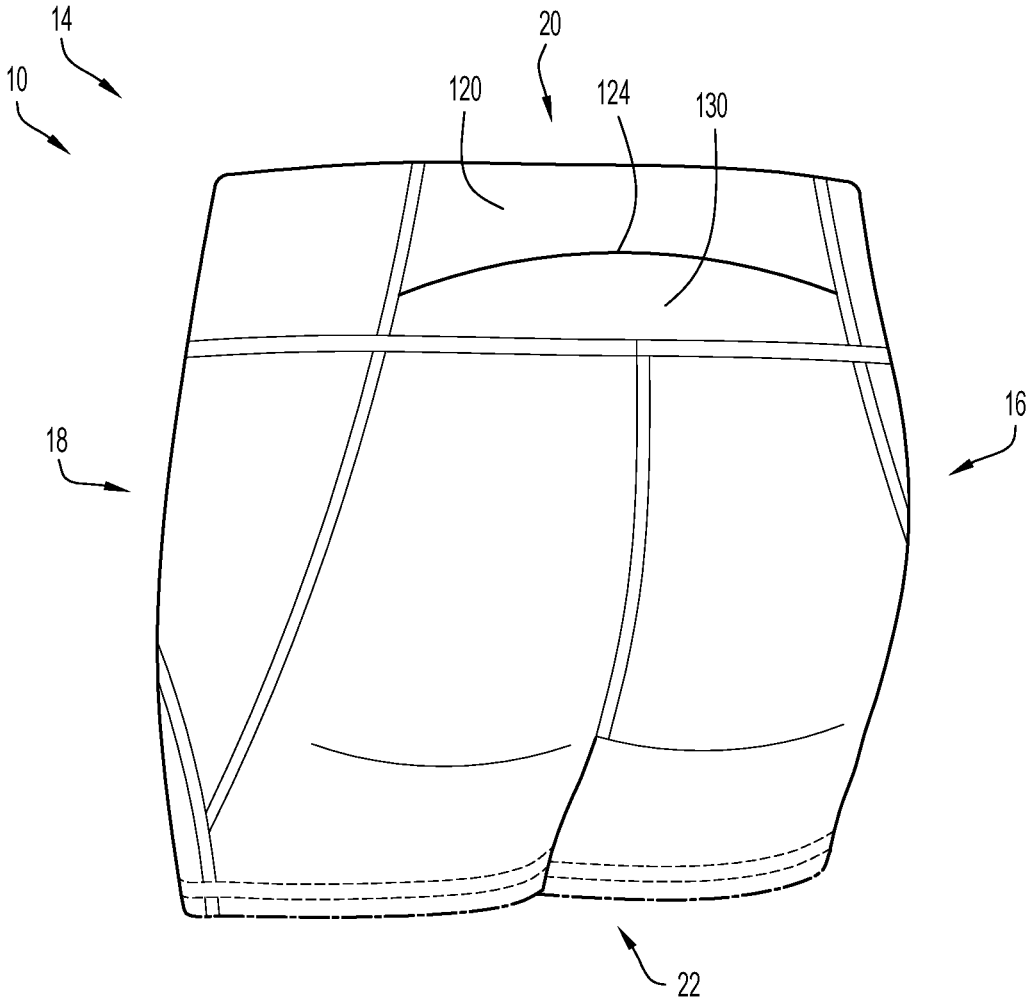
FIG. 8 illustrates a rear perspective view of a schematic diagram of the embodiment of the garment illustrated in FIG. 1A.
Figure 9:
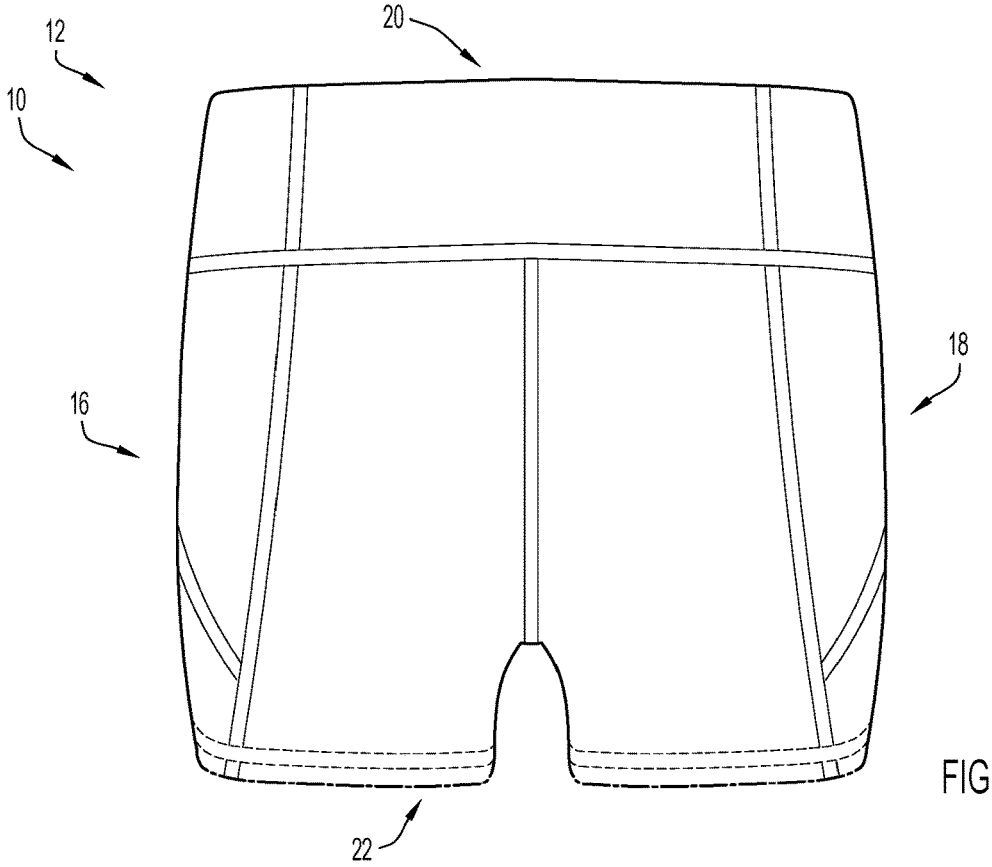
FIG. 9 illustrates a front view of the schematic diagram illustrated in FIG. 8.
Figure 10:
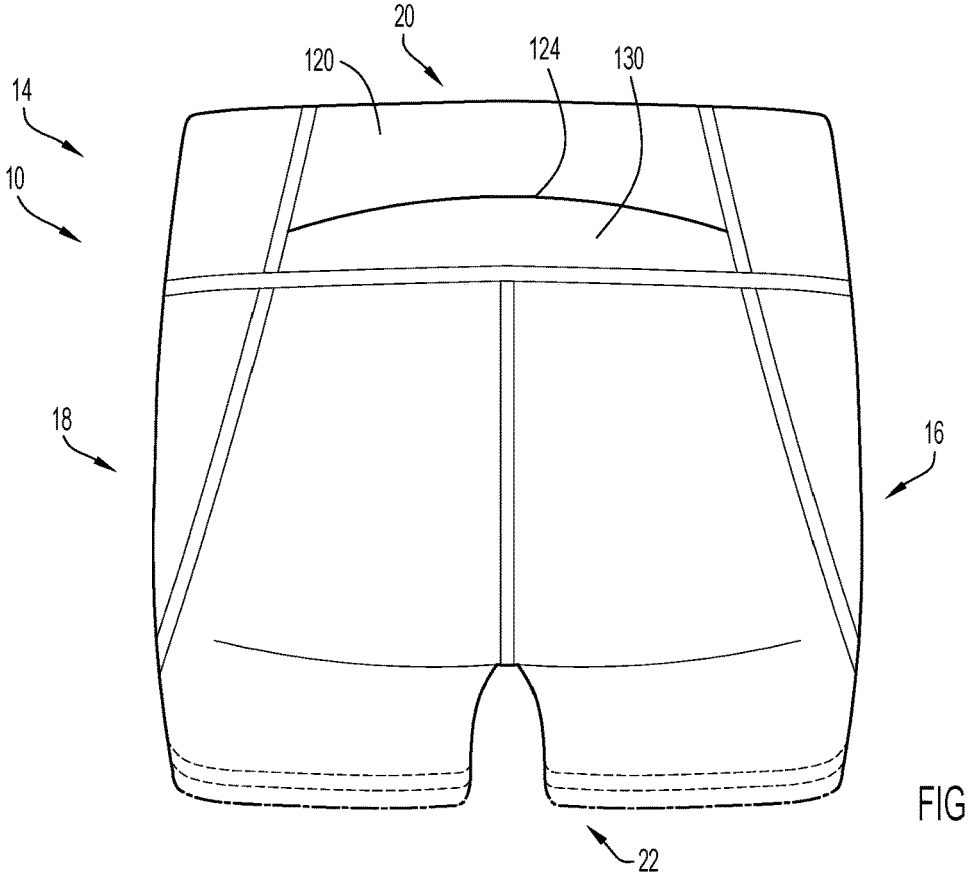
FIG. 10 illustrates a rear view of the schematic diagram illustrated in FIG. 8.
Figure 11:
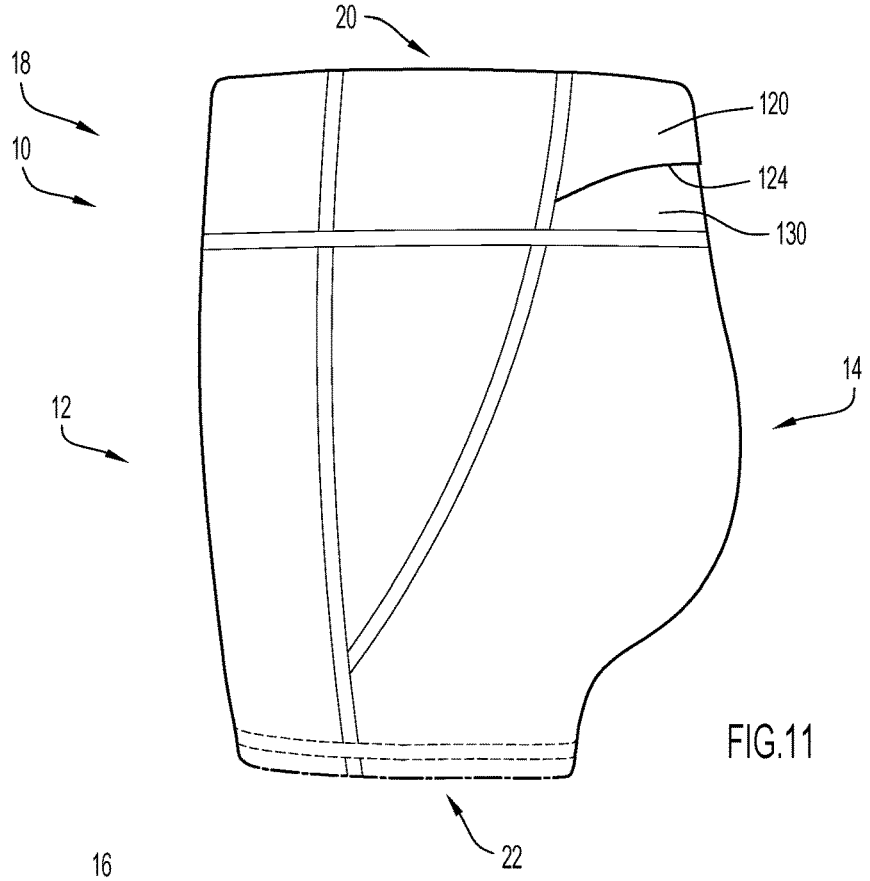
FIG. 11 illustrates a side view of the second side (e.g., left side) of the schematic diagram illustrated in FIG. 8.
Figure 12:
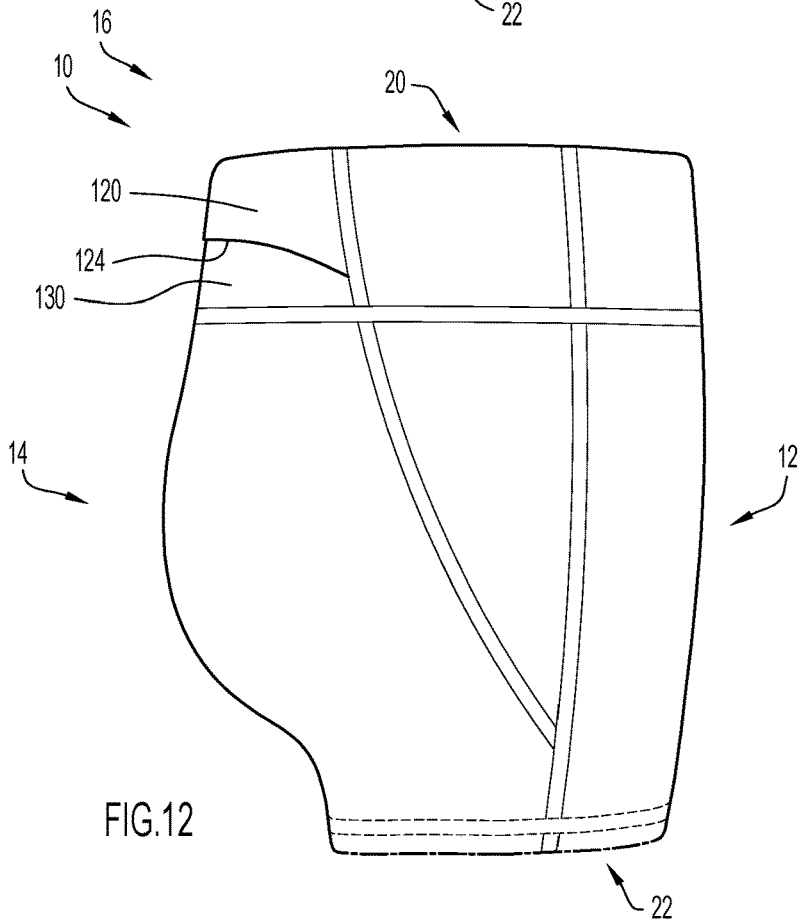
FIG. 12 illustrates a side view of the first side (e.g., right side) of the schematic diagram illustrated in FIG. 8.
Figure 13:
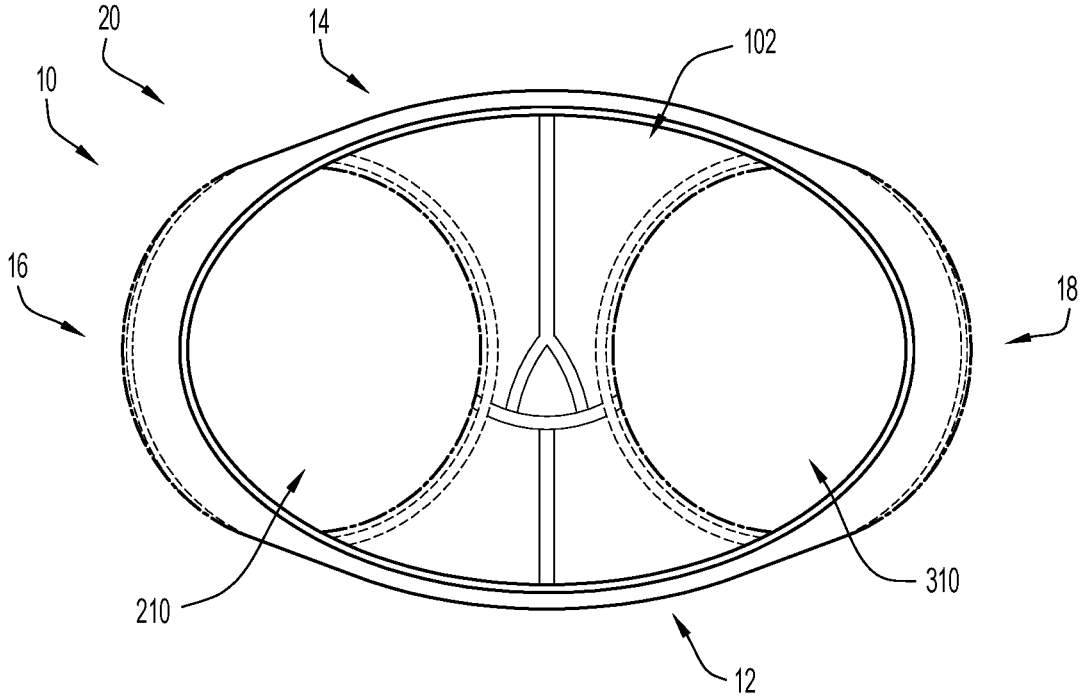
FIG. 13 illustrates a top view of the schematic diagram illustrated in FIG. 8.
Figure 14:
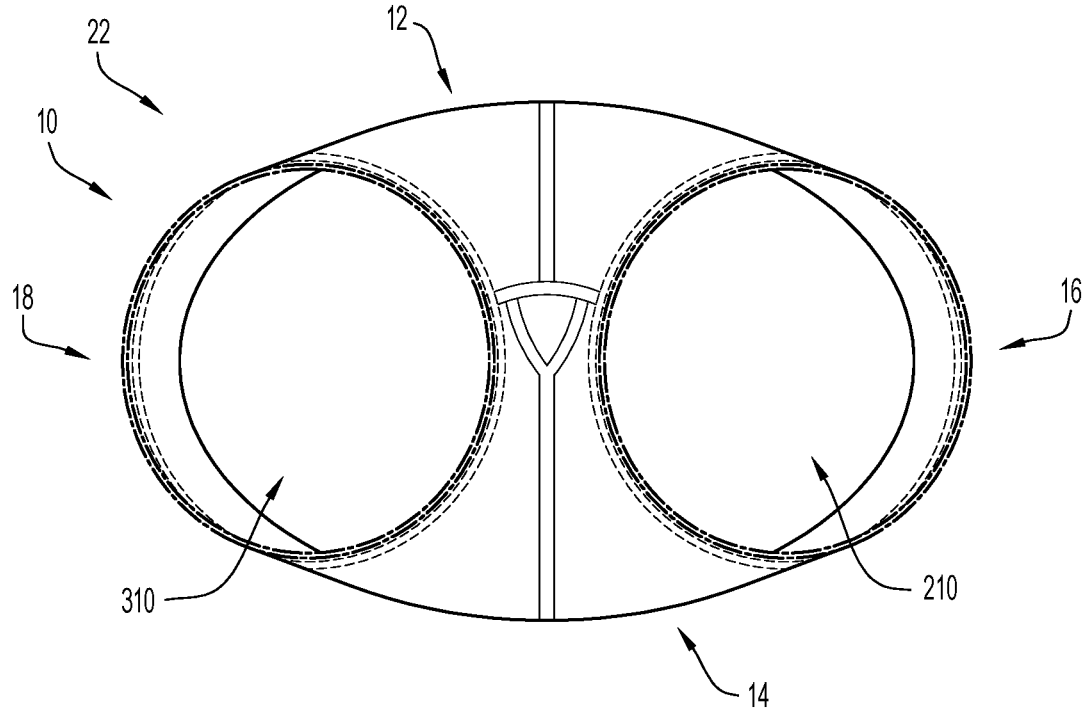
FIG. 14 illustrates a bottom view of the schematic diagram illustrated in FIG. 8.

As illustrated in FIGS. 6A, 6B, 6C, and 7A, when a wearer of the pants 10 wishes to store an item, such as a smartphone, 400 within the pocket 150 of the fourth panel 110, the wearer must lift and stretch the bottom edge 124 of the first flap 120 upwards towards the top edge 122 of the first flap 120 while also pulling downward on the top edge 132 of the second flap 130 to expose the aperture 156 of the pocket 150. The wearer of the pants 10 can then begin to slip the item 400 into the aperture 156 by sliding the item 400 beyond the bottom edge 124 of the first flap 120 and the top edge 132 of the second flap 130 (i.e., sliding the item 400 over the bottom edge 124 the first flap 120 and under the top edge 132 of the second flap 130). Once the item 400 is slid entirely into the pocket 150, such that the entire item 140 is placed between the interior surface 138 of the second flap 130 and the backing material 152, the tension in the first and second flaps 120, 130, caused by the lateral load that laterally stretches of the waist portion 100, automatically draws the bottom edge 124 of the first flap 120 down and over the top edge 132 of the second flap 130 to securely enclose the item 400 within the pocket 150. As illustrated in FIG. 7B, the first flap 120 serves as a cap, lid, or cover to the pocket 150 formed by the second flap 130 and the backing material 152. In other words, the first flap 120 serves as a tension closure to the pocket 150 formed by the second flap 130 and the backing material 152. The tension forces in the first and second flaps 120, 130 will retain the first and second flaps 120, 130 in the closed position A, and will securely store the item(s) 400 within the pocket 150 during movements performed by the wearer of the pants 10, such as walking, running, jumping, sitting, etc.

As further illustrated in FIG. 7B, the item(s) 400, when stored within the pocket 150 of the fourth panel 110, is positioned proximate to the lower back of the wearer of the pants 10. Thus, the lines on the surface of the pants 10 created by the item(s) 400 in the pocket 150 are not located along the unwanted areas of the body (i.e., the front of the thighs, the buttocks, the front of the waist, the sides of the hips, etc.). Accordingly, the wearer of the pants 10 can store item(s) 400 in the pocket 150 of the fourth panel 110 of the waist portion 100 of the pants 10 without creating any unwanted or unflattering shapes for the wearer. The location of the pocket 150 further allows the user to engage in activities such as walking, jogging or running without limiting movements of the thighs, hips and associated muscles of the user during such activities.

FIGS. 8-14 illustrate schematic diagrams of an embodiment of the pants 10 with a tension closure pocket as described herein.

While the invention has been described in detail and with reference to specific embodiments thereof, it will be apparent to one skilled in the art that various changes and modifications can be made therein without departing from the spirit and scope thereof.

Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An article of clothing comprising:

a lower portion configured to be positioned around at least one leg of a person wearing the article of clothing; and an upper portion coupled to the lower portion and configured to be oriented around a waist of the person wearing the article of clothing, the upper portion including:

a backing panel;

a first flap coupled to the backing panel, the first flap containing a top edge and an opposite arcuate bottom edge; and a second flap coupled to the backing panel, wherein the first flap is at least partially disposed over the second flap such that the arcuate bottom edge is disposed over the second flap, and the backing panel, the first flap, and the second flap define a pocket.

2. The article of clothing of claim 1, wherein the backing panel, the first flap, and the second flap comprise fabrics that include an elastomeric material.

3. The article of clothing of claim 2, wherein the first flap and the second flap are repositionable between a closed position and an open position, the first flap is at least partially disposed over the second flap in the closed position, and the first flap is at least partially spaced from the second flap in the open position to provide access to the pocket.

4. The article of clothing of claim 3, wherein stretching the upper portion in a lateral direction that opposes a lengthwise direction of the article of clothing creates tensile forces that retain the first flap and the second flap in the closed position.

5. The article of clothing of claim 1, further comprising an inner pocket disposed within the pocket.

6. The article of clothing of claim 1, wherein the upper portion includes a top edge and a bottom edge, and the second flap includes a top edge and a bottom edge.

7. The article of clothing of claim 6, wherein the bottom edge of the second flap is coupled to the bottom edge of the upper portion while the top edge of the second flap is disposed proximate to the top edge of the upper portion, and the top edge of the first flap is coupled to the top edge of the upper portion while the arcuate bottom edge of the first flap is disposed over the second flap so that the arcuate bottom edge of the first flap is disposed between the top edge and the bottom edge of the second flap.

8. An article of clothing comprising:

a lower portion configured to be positioned around legs of a person wearing the article of clothing; and an upper portion coupled to the lower portion and configured to be oriented around a waist of the person wearing the article of clothing, the upper portion including:

a backing panel;

a first flap coupled to the backing panel, the first flap having an exterior surface, an interior surface, a top edge, and an arcuate bottom edge; and a second flap coupled to the backing panel, the second flap having an exterior surface and an interior surface, wherein at least a portion of the interior surface of the first flap abuts at least a portion of the exterior surface of the second flap, and the backing panel, the first flap, and the second flap define a pocket.

9. The article of clothing of claim 8, wherein the upper portion defines an opening configured to receive the waist of the person wearing the article of clothing.

10. The article of clothing of claim 9, wherein the upper portion is constructed from a fabric that includes an elastomeric material.

11. The article of clothing of claim 10, wherein the first flap and the second flap are repositionable between a closed position and an open position, the interior surface of the first flap abuts the exterior surface of the second flap when in the closed position, and the interior surface of the first flap being at least partially spaced from the exterior surface of the second flap when in the open position to provide access to the pocket.

12. The article of clothing of claim 11, wherein stretching the upper portion in a lateral direction that opposes a lengthwise direction of the article of clothing creates tensile forces that retain the first flap and the second flap in the closed position.

13. The article of clothing of claim 8, wherein the lower portion comprises:

a first leg portion configured to receive a first leg of the person wearing the article of clothing; and a second leg portion configured to receive a second leg of the person wearing the article of clothing.

14. The article of clothing of claim 13, wherein the first leg portion and the second leg portion are constructed from fabrics that include an elastomeric material.

15. An article of clothing comprising:

a lower portion configured to be positioned around legs of a person wearing the article of clothing; and an upper portion coupled to the lower portion and configured to be oriented around a waist of the person wearing the article of clothing, the upper portion including:

a backing panel;

a first flap coupled to the backing panel, the first flap having a top edge and an opposite arcuate bottom edge; and a second flap coupled to the backing panel, wherein the backing panel, the first flap, and the second flap collectively define a pocket, and the first flap and the second flap are configurable between a closed position, where the first flap at least partially covers a portion of the second flap, and an open position, where the first flap is spaced apart from the second flap to provide access to the pocket.

16. The article of clothing of claim 15, further comprising an inner pocket disposed within the pocket.

17. The article of clothing of claim 15, wherein the upper portion is constructed from a fabric that includes an elastomeric material.

18. The article of clothing of claim 17, wherein when the upper portion is oriented around the waist of the person wearing the article of clothing, the waist stretches the upper portion outwardly, creating tensile forces that retain the first flap and the second flap in the closed position.

19. The article of clothing of claim 15, wherein the upper portion includes a top edge and a bottom edge, and the second flap includes a top edge and a bottom edge.

20. The article of clothing of claim 19, wherein the bottom edge of the second flap is coupled to the bottom edge of the upper portion while the top edge of the second flap is disposed proximate to the top edge of the upper portion, and the top edge of the first flap is coupled to the top edge of the upper portion while the arcuate bottom edge of the first flap is disposed over the second flap so that the arcuate bottom edge of the first flap is disposed between the top edge and the bottom edge of the second flap.

* * * * *